US005494272A

United States Patent [19]

Golicz

[11] Patent Number: 5,494,272

[45] **Date of Patent: * Feb. 27, 1996**

[54] HIGH CAPACITY SHEET FEEDERS FOR HIGH VOLUME PRINTERS

[75] Inventor: Roman M. Golicz, Clinton, Conn.

[73] Assignee: Roll Systems, Inc., Burlington, Mass.

[ * ] Notice: The portion of the term of this patent subsequent to Aug. 30, 2011, has been disclaimed.

[21] Appl. No.: 265,250

[22] Filed: Jun. 24, 1994

Related U.S. Application Data

[63] Continuation of Ser. No. 975,508, Nov. 12, 1992, Pat. No. 5,342,036, which is a continuation-in-part of Ser. No. 775, 200, Oct. 9, 1991, Pat. No. 5,167,408.

[51] Int. Cl.[6] ..... B65H 5/22

[52] U.S. Cl. ..... 271/3.03; 271/152; 271/153; 271/163; 271/157

[58] Field of Search ..... 271/3.1, 163, 212, 271/149, 152, 153, 157, 161, 162

[56] References Cited

U.S. PATENT DOCUMENTS

| | | | |
|---|---|---|---|
| 1,396,622 | 11/1921 | Bullen et al. . | |
| 1,969,946 | 8/1934 | Root . | |
| 2,161,124 | 6/1939 | Babicz . | |
| 2,992,820 | 7/1961 | Tarbuck et al. . | |
| 3,240,488 | 3/1966 | Lyman . | |
| 3,683,758 | 8/1972 | Feldkamper . | |
| 3,894,732 | 7/1975 | Müller . | |
| 3,944,213 | 3/1976 | Fallos et al. . | |
| 4,025,068 | 5/1977 | Collins . | |
| 4,128,236 | 12/1978 | Lundblad . | |
| 4,177,982 | 12/1979 | Bewersdorf et al. . | |
| 4,180,259 | 12/1979 | Bewersdorf et al. . | |
| 4,369,959 | 1/1983 | Hornbuckle | 271/3.1 |
| 4,376,530 | 3/1983 | Akai . | |
| 4,397,455 | 8/1983 | Hickey . | |
| 4,478,400 | 10/1984 | Commers | 271/3.1 |

(List continued on next page.)

FOREIGN PATENT DOCUMENTS

| | | |
|---|---|---|
| 362404 | 5/1981 | Austria . |
| 1127193 | 7/1982 | Canada . |
| 0115208 | 8/1984 | European Pat. Off. . |
| 0416490 | 3/1991 | European Pat. Off. . |
| 2657855 | 8/1991 | France . |
| 1910160 | 3/1968 | Germany . |
| 1957281 | 5/1971 | Germany . |
| 2650564 | 2/1978 | Germany . |
| 3005569 | 9/1980 | Germany . |
| 3508981 | 8/1986 | Germany . |
| 3723589 | 1/1989 | Germany . |
| 424448 | 11/1966 | Switzerland . |
| 544026 | 12/1973 | Switzerland . |
| 2196324 | 4/1988 | United Kingdom . |

OTHER PUBLICATIONS

A. B. Habich & G. M. Yanker, IBM Technical Disclosure Bulletin, vol. 17, No. 7, pp. 1848–1849, Dec. 1974.

*Primary Examiner*—David H. Bollinger
*Attorney, Agent, or Firm*—Wolf, Greenfield & Sacks

[57] ABSTRACT

A high speed sheet feeder for directing sheets to a host utilization device having a stack feed elevator platform accessed by a drawer provides a feed ramp for supporting a stack of sheets. Sheets in the stack are deshingled by a feeder singulator and driven, typically, downwardly to a feed tray extending remote from the singulator. The feed tray receives sheets in a space that enables formation of a second smaller stack of sheets. The tray further includes an opening adjacent the second stack that enables sheets to be slid from the top of the second stack. The tray is positioned and constructed so that it can enter and be removed from a port in the drawer of the utilization device. The feed tray's positioning relative to the port allows sheets in the second stack to be placed adjacent a utilization device singulator in the drawer so that sheets can be removed by the utilization device singulator for processing thereby. In utilization devices having two drawers positioned one a top the other, the tray can be constructed so that the drawer not interfaced with the tray can be accessed for loading without removing the tray from the other drawer.

23 Claims, 29 Drawing Sheets

U.S. PATENT DOCUMENTS 4,500,084 2/1985 McInerny .
4,607,832 8/1986 Abe .
4,715,593 12/1987 Godlewski .
4,744,555 5/1988 Naramore et al. .
4,786,040 11/1988 Thomsen ..... 271/3.1
4,871,162 10/1989 Imai et al. .
4,981,292 1/1991 Cosgrove .
5,026,340 6/1991 Thompson ..... 271/212 X
5,342,036 8/1994 Golicz ..... 271/3.1

HIGH CAPACITY SHEET FEEDERS FOR HIGH VOLUME PRINTERS

RELATED APPLICATIONS

This application is a continuation of application Ser. No. 07/975,508, filed Nov. 12, 1992, now U.S. Pat. No. 5,342,036 which is a continuation-in-part of U.S. patent application Ser. No. 07/775,200 filed Oct. 9, 1991, now U.S. Pat. No. 5,167,408.

This invention relates to extremely high capacity sheet feeders, for supplying a block of as many as thirty reams of paper sheets, automatically fed to the infeed mechanism of such high volume printers as the Xerox® printer model 9500, 9700, 4090, photocopiers or other sheet paper using "host" machines.

RELATED ART

These high volume copiers or cut sheet printers are each provided with paper supply feed mechanisms, consisting of an elevator platform adapted for vertical elevation. A variable capacity stack of paper sheets, generally 500 to 4,000 sheets, is placed on the platform, which is elevated on command until the uppermost sheet contacts the printer's feed mechanism. The ascent of the paper stack is stopped by the printer's feed mechanism limit switch.

As the uppermost paper sheets are fed into the printer, the limit switch is deactivated, thus raising the platform and the remaining stack of paper sheets until the cycle is repeated.

When this load of sheets has been fed through the copier or printer, a "reload" time of between two and five minutes may be required to place up to eight more reams of paper sheets on the tray in succession, with proper edge alignment for feed registration. The loading operation, therefore, consumes between 10 and 25% of the printer's total operating time.

BRIEF SUMMARY OF THE INVENTION

The slanting loading ramp and feed mechanism of this sheet feeder invention permits as many as thirty reams or 15,000 sheets of paper to be loaded and aligned as an elongated block or feed stock column, at the user's convenience, without interfering with the printer's normal high volume printing operations. A very brief interruption permits the loading ramp of the present invention to advance its total feed stock column into feeding position, and the counterbalanced infeed tray of the feeder is already in the feeding position, ready to continue resupplying the printer.

When access to the infeed tray of the high volume printer is desired for normal operation, adjustments, inspection or maintenance, the sheet feeder of the present invention can be entirely unlatched and rolled away along an underlying track, providing ample access to all sides of the host machine.

These high volume copiers and printers take their infeed sheets from the top of the sheet stack on the elevator tray. As long as the level and hence the position of the top of the paper stack does not vary by more than approximately five to eight sheets, the elevator tray will not received the ascend signal from the printer's feed mechanism limit switch. Therefore, once the paper stack normally placed on the elevator tray by the operator is replaced by the similar stack of paper resting on the counterbalanced infeed tray of the high capacity feeder, the printer's feeding mechanism is unable to distinguish between the two. The loading ramp devices of the present invention feed fresh shingled sheets to the bottom of the stack on the feeder's counterbalanced infeed tray, employing a unique singulating and/or shingling feed mechanism which has the additional advantage of avoiding snagging of any perforations along the edges or body of the sheets being delivered to the underside of the stack on the counterbalanced infeed tray of the high capacity feeder. The level of the stack is maintained through the use of a level sensing bar which controls the resupply on demand whenever three to five sheets are needed.

It is a principal object of the present invention to provide high capacity sheet feeders for highly efficient supply of paper sheets to high volume printers, copying machines, etc., without the need of communicating with the host machine, minimizing or eliminating printer downtime for infeed sheet loading.

Another object of the invention is to provide such high capacity sheet feeders employing a diagonal loading ramp capable of carrying as many as thirty reams of paper sheets.

Still another object of the invention is to provide such sheet feeding devices which are capable of singulating and/or shingling sheets fed from the device to the underside of an infeed sheet stack on the feeder's counterbalanced infeed tray platform, and presenting the platform and stack to a high volume printer or similar machine.

A further object of the invention is to singulate and/or shingle the paper sheets delivered to the infeed platform in an overlapping feed stream sufficiently fanned to eliminate intersheet "fibre-lock" friction force in order to insure that the infeed paper sheet stack is in optimum condition for single sheet feeding through the high volume printer or other machine.

Another object of the invention is to provide automatic feed advance of the entire multiream column of sheets to be delivered to the feeder's counterbalanced infeed tray platform, thus providing automatic and continuous resupply of singulated shingled sheets to the host machine's feeding mechanism.

Still another object of the invention is to provide high capacity sheet feed loaders of this character with fail safe and foolproof limit switches, avoiding the possibility of jamming or interruption of normal feed operations, and of damage to the host machine.

Yet another object of this invention is to provide a system for feeding front and drawer loaded printers and copiers such as the Xerox® model 4090, IBM models 3827/28 and Kodak model 1392 printers.

Other objects of the invention will in part be obvious and will in part appear hereinafter.

The invention accordingly comprises the features of construction, combination of elements, and arrangement of parts which will be exemplified in the construction hereinafter set forth, and the scope of the invention will be indicated in the claims.

THE DRAWINGS

For a fuller understanding of the nature and objects of the invention, reference should be made to the following detailed description taken in connection with the accompanying drawings, in which.

DETAILED DESCRIPTION OF THE PREFERRED EMBODIMENTS

Figure 1:
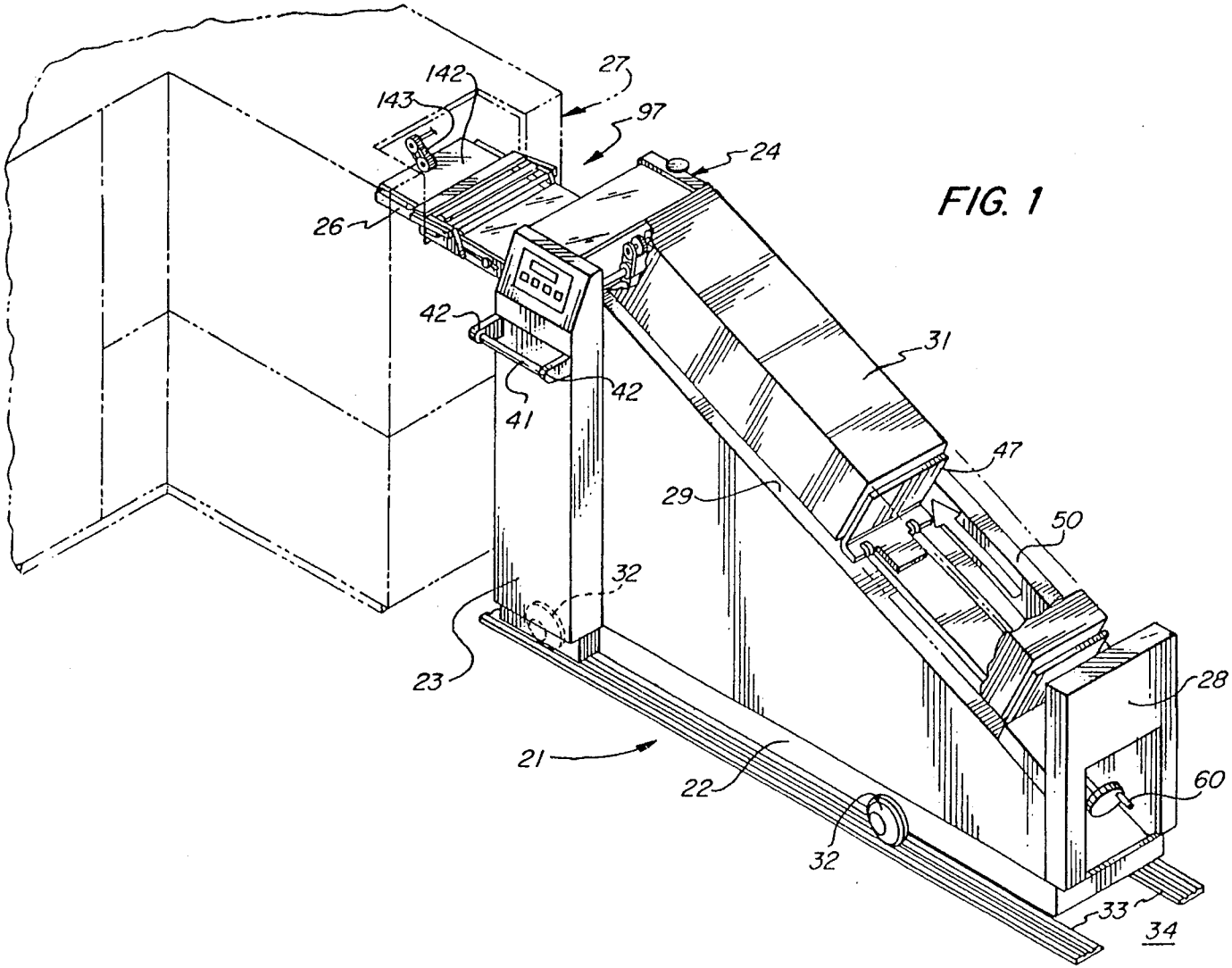
FIG. 1 is a perspective diagrammatic view of the high capacity sheet feeder of the present invention shown in operating position with its counterbalanced infeed tray under the feed mechanism of a high volume printer, such as the Xerox model 9500, which is shown in dot-dash lines at the left side of the figure.

The high capacity sheet feeder 21 shown in the figures comprises a base frame 22 of elongated rectangular configuration, having at one end a vertical support column 23 underlying and supporting a singulating shingling mechanism 24, which has a counterbalanced sheet infeed tray platform 26 cantilevered outward from the left end of the feeder 21 shown in FIG. 1 to engage the feed mechanism 143 of a high volume host machine 27 such as the Xerox Model 9500 or Model 9700 printer. Sloping diagonally upward from a short end column 28 at the opposite "loading" end of base frame 22 is a slanting loading feed ramp 29 on which as many as thirty reams or 15,000 sheets of paper to be fed to printer 27 can be stacked edgewise in an elongated resupply feed block 31. Column 28 houses resupply feed motor M and the resupply drive and transmission assembly.

Figure 2:
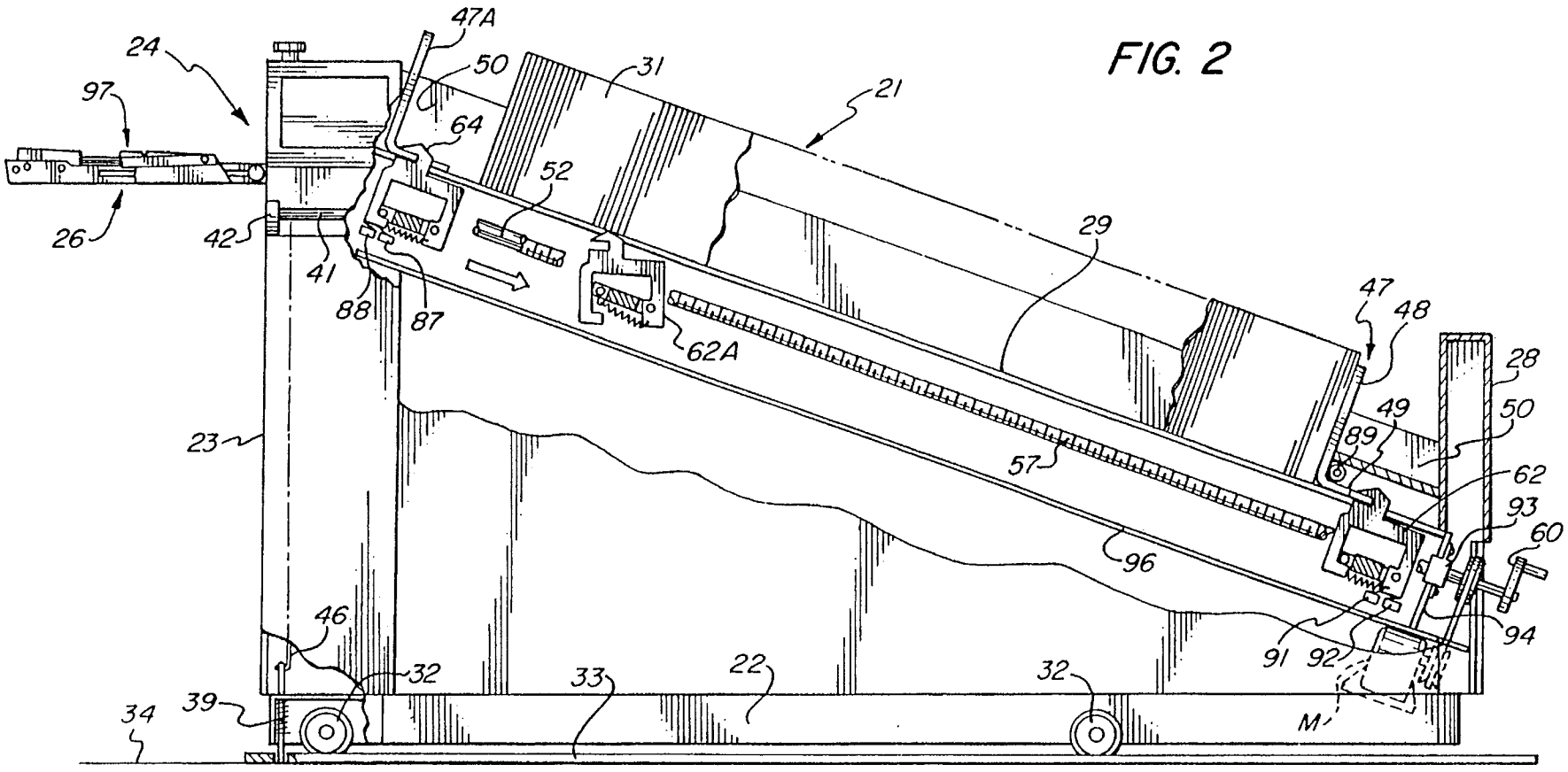
FIG. 2 is a front elevation view of the high capacity sheet feeder of the present invention, partially broken away to shows its internal construction.

Support column 23, base frame 22 and end panel 28 form with loading feed ramp 29 a sturdy and stable triangular structure, easily capable of supporting this entire load of thirty reams of paper, extending on the slanting ramp 29 from its low loading end up to its high feed end, or from right to left as viewed in FIGS. 1 and 2. Sheet feeder 21 is supported on rollers 32 engaging a pair of tracks 33 anchored firmly in position on the supporting floor 34 by adhesive 36, which may be double sided adhesive tape, for example, shown in FIG. 5, applied directly to carpet, vinyl or other flooring.

Figure 5:
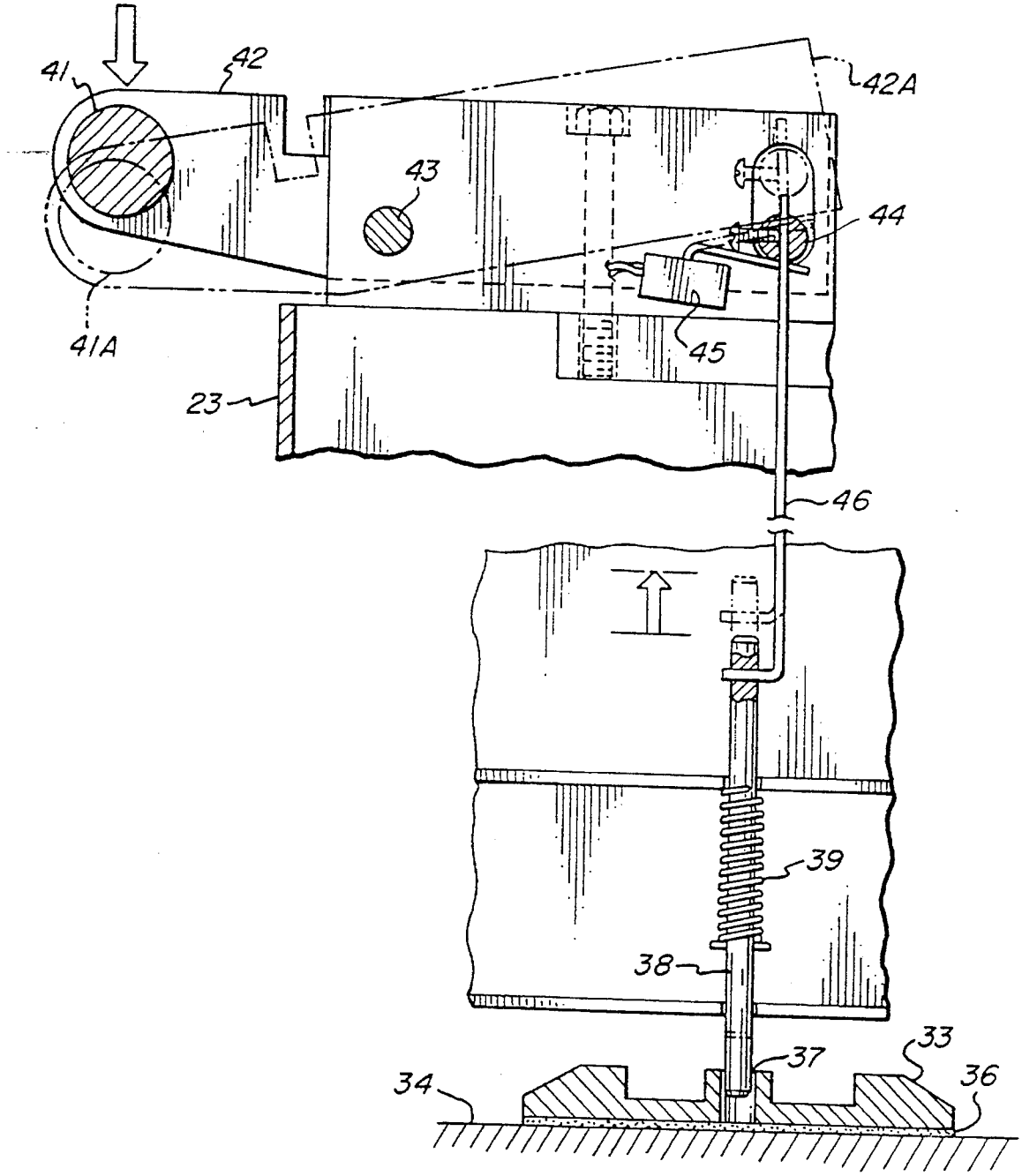
FIG. 5 is a fragmentary cross-sectional diagrammatic end view of the track latch mechanism securing the feeder in its operating position and capable of releasing it for rollaway servicing, maintenance, or normal operation of the host machine, without the high capacity feeder.

As shown in FIG. 5, the front track 33 is provided with a lock aperture 37 in which a vertically withdrawable locking bolt 38 is normally engaged, and held in position by a biasing spring 39 urging the bolt 38 downwardly into the lock aperture 37. The mechanism illustrated in FIG. 5 allows the locking bolt 38 to be withdrawn whenever an unlocking bar 41 is depressed downward to the dot-dash line position 41A shown in FIG. 5.

Unlocking bar 41, best seen in FIGS. 1 and 2, extends lengthwise across the front of column 23 at the user's waist height between two pivot arms 42. As shown in FIG. 5, arms 42 are pivoted in the upper front portion of column 23 on a pivot pin 43, and are thus movable between the solid line position 42 and the dot-dash line position 42A shown in FIG. 5.

In the position 42A, pivot arms 42 raise an anchor block 44 mounted at the rear end of arms 42 and clamped by a set screw to the upper end of an actuator rod 46, whose lower end is anchored to the upper end of locking bolt 38, all as shown in FIG. 5. Downward movement of unlocking bar 41 thus raises actuator rod 46 and bolt 38, releasing a microswitch 45 to switch the feeder's power off, withdrawing the bolt from lock aperture 37 and freeing the entire sheet feeder 21 for rolling movement on rollers 32 along track 33 in a direction away from printer 27 to the right in FIG. 1. This rolling movement withdraws the singulator shingling mechanism 24 and the counterbalanced sheet infeed platform 26 from printer 27, and allows free access to all sides of printer 27 for normal operation, inspection, maintenance, repairs or the like.

Feed Ramp

Figure 3:
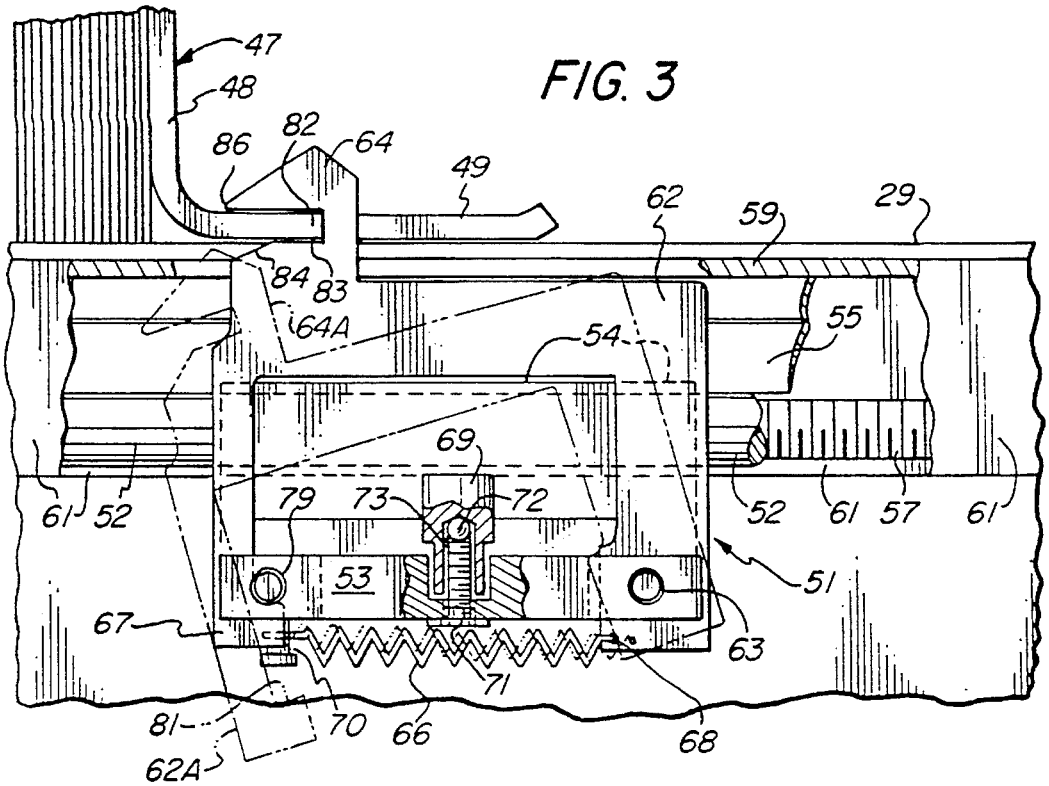
FIG. 3 is a fragmentary enlarged front elevation view of the cooperating components of the feed mechanism of the device.

The diagonally slanting feed ramp 29 is best seen in the broken away side elevation view of FIG. 2, where an elongated block of multiple reams of paper sheets is shown positioned on the diagonal ramp 29. A pusher plate 47 is shown at the right hand side of FIG. 2 and is L-shaped in configuration, with its tallest arm 48 leaning against the lower end of sheet feed block 31 in the manner of a bookend while its shorter arm 49 extends along and rests upon ramp 29. A fragmentary enlarged view of pusher plate 47 is also shown in FIG. 3 and a perspective view of the pusher plate also appears in FIG. 1.

As shown in the figures, a drive carriage 51 is mounted for movement with most of its structure positioned directly beneath loading ramp 29 for sliding engagement with a guide rod 52 suspended along the lower edge of a depending web plate 55 mounted on the underside of ramp 29. As shown in the end elevation view of FIG. 4, carriage 51 incorporates a base 53 underlying a sleeve block 54 incorporating a longitudinal cylindrical sleeve passage 56 slidingly engaging the guide rod 52. Sleeve block 54 is shown bolted to base 53 in FIG. 4, and is indicated in solid and dash lines in FIG. 3. Beside longitudinal guide rod 52 is a longitudinal feed screw 57 also positioned under ramp 29 directly above base 53 of drive carriage 51. The drive carriage is provided with a threaded feed nut 58 bolted to base 53, with threads engaging the mating threads of feed screw 57.

Figure 4:
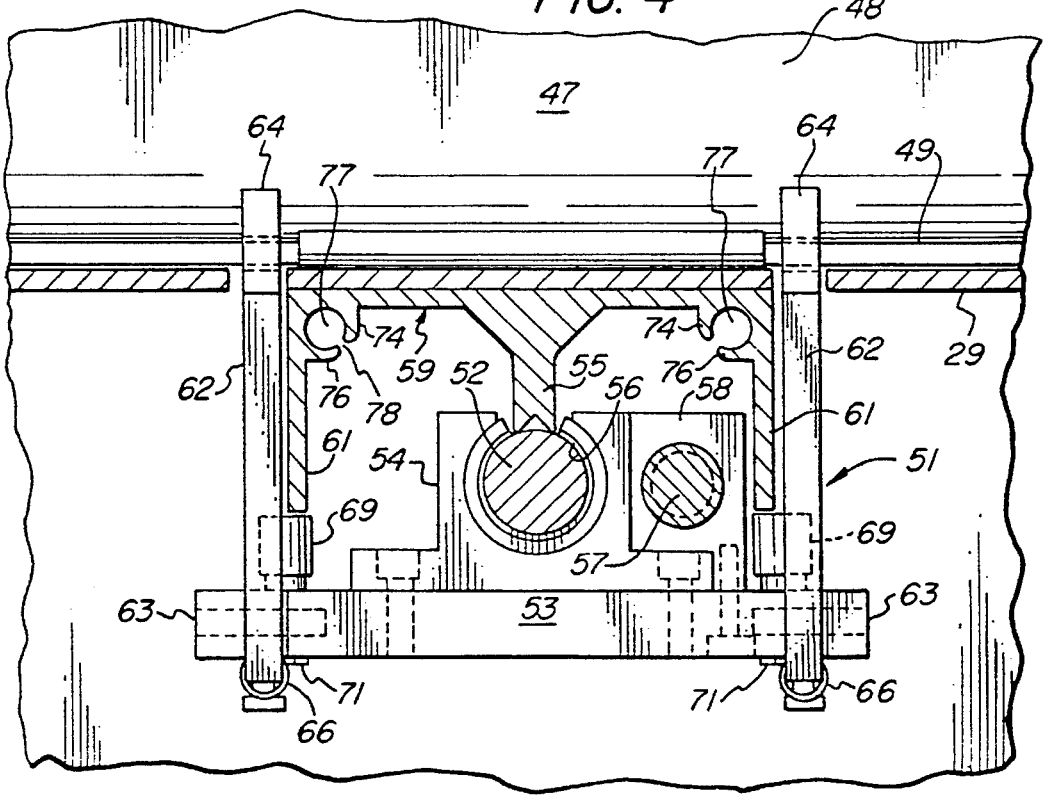
FIG. 4 is a fragmentary cross-sectional end elevation view of the same feed mechanism components.

The guide rod 52 and its supporting web 55 are suspended centrally from the underside of a guide rail channel 59 anchored to the underside of feed ramp 29 and having elongated rectangular downwardly depending rails 61 along its entire length under ramp 29. The lower edges of rails 61 are spaced above the normal position of base 53, as indicated in FIG. 4. A small portion of the nearer rail 61 is shown at the right and left sides of FIG. 3, and the lower edge of the remote opposite rail 61 is shown just beneath feed screw 57 in FIG. 3.

A pair of pivoted hooked side plates 62 are pivotally mounted on base 53 by pivots 63. As indicated in FIGS. 3 and 4, side plates 62 are free to pivot between two working positions, a drive position illustrated in solid lines in FIG. 3, in which upper drive hooks 64 are in position for engagement with the pusher plate 47, and a retracted position 62A shown in dot-dash lines in FIG. 3, in which the drive hooks 64 are lowered to a position 64A again shown in dot-dash lines in FIG. 3. In this retracted position, the drive hooks 64 are beneath pusher plate 47, leaving the entire carriage 51 and its associated drive hooks 64 free for return movement from the upper end of ramp 29, beneath the multiple sheet feed block 31 on the ramp, to a lower position near the lower end of ramp 29, where they may again be engaged with the next pusher plate, ready to drive a new multiple sheet feed block 31 up ramp 29 to follow the previous feed block into feeding position.

Resilient tension coil springs 66 have their ends secured in suitable anchor fittings 70 in the forward end 67 of the carriage base 53, and their rear ends suitably anchored in side plates 62 beneath pivot 63 at the rear end of the side plate, by anchor fittings 68 formed in this lower corner of each pivoted hooked side plate 62. Coil springs 66, being installed under tension, resiliently urge side plates 62 toward their solid line position shown in FIG. 3 with their drive hooks 64 engaging the pusher plate 47. However, when drive screw 57 is rotated in its reverse direction, causing feed nut 58 and the entire carriage 51 connected thereto to traverse back down the sloping structure toward its lower end, hooks 64 are urged downwardly under the feed block 31 of multiple paper sheets, into the dot-dash line position 62A shown in FIG. 3 for the passage back down ramp 29 under the entire feed block 31, with the coil springs 66 being correspondingly stretched during this downward traverse of the carriage 51.

In order to adjust carriage 51 and its side plates 62 for minimum friction on guide rod 52 and feed screw 57, a pair of adjustable rail guides 69 are mounted in the base 53, projecting upward respectively against the depending lower edges of rails 61. The structure of each rail guide 69 is shown in the fragmentary cross-sectional central portion of FIG. 3, where the rail guide is shown to have a flat upper surface engaging the lower edge of rail 61. Each rail guide 69 has a central bore 73, loosely accommodating an adjustment screw 71 with a stainless steel ball 72 at its upper end centering rail guide 69 directly along the axis of the adjustment screw 71 in the conical blind end of the central bore 73 of the rail guide 69. Adjustment screw 71 is threaded into base 53, as indicated in FIG. 3 and the central bore 73 of guide 69 is oversized and not engaged with the threads of adjustment screw 71.

Formed in the upper inside corners of the channel shaped guide rail 59 are flanges 74, depending from the flat central web portion of the guide rail 59, with their edges in close juxtaposition to the edges of inwardly extending flanges 76, protruding inward from the upper portion of each rail 61 and forming enlarged recesses 77, useful as wiring and guide tunnels, accessible through inwardly facing diagonal slots 78 between flanges 74 and 76, through which wiring cables and the like may be inserted during assembly.

Adjustment of the adjustment screws 71 on each side of base 53 to raise the rail guides 69 into sliding contact with the lower edges of the rail 61 assures smooth guiding alignment of carriage 51 along the guide rod 52 and feed screw 57 while minimizing any misalignment forces applied by the hooked side plates 62 engaging pusher plate 47, which might tend to cause binding or excessive friction between the carriage 51 and the guide rod 52 or the feed screw 57. It should be noted that the base 53 of drive carriage 51 is provided at its forward end with a stop pin 79 protruding outwardly from the lateral edge of base 53 into interfering alignment with a stop ledge 81 formed at the forward lower corner of side plate 62, facing in the direction of pivot pin 63 and positioning the hook 64 at the correct height for engaging the rear flange edge of shorter arm 49 of pusher plate 47, as indicated at the upper portion of FIG. 3. The driven edge 82 of this shorter arm flange 49 of pusher plate 47 fits into a mating hook slot 83 formed in the hook 64 of side plate 62. Slot 83 has a beveled lower portal lip 84 for sliding entry of the driven edge 82 into the slot 83. The upper lip 86 of hook slot 83 extends forward over the driven edge 82 by an appreciable distance, thereby stabilizing pusher plate 47 in its driving engagement with side plate 62 and preventing the pusher plate from rocking or leaning backward under the load provided by the sheet feed block 31, whose considerable weight would otherwise tend to tilt pusher plate 47 backward over side plate 62.

Paper Sheet Block Loading Operation

As indicated in FIG. 1, pusher plate 47 supplies translation force tending to move the entire sheet feed block 31 up ramp along the ramp 29 from the loading end to the feed end of the ramp closely adjacent to the singulating feed assembly 105 and counterbalanced infeed tray 26. The delivery, singulation and shingling of the individual sheets at the feed end of feed block 31 will be described in detail hereinafter. As sheets are removed from the feed end of the feed block, automatic sensors produce advancing movement of feed screw 57, revolved by a feed screw drive motor M which is preferably positioned in column 28 at the lower end of the feed screw 57 as indicated schematically in FIG. 2.

Advancing feed rotation of the feed screw 57 causes the pusher plate 47 to move upward along diagonal ramp 29, as previously described. When the pusher plate 47 reaches its uppermost position 47A shown at the left side of FIG. 2, all the rest of ramp 29 provides ample room for reloading of a new elongated multiple ream column of sheets forming the feed block 31, aligned against a rear paper guide 50 as indicated in FIG. 2, with a new pusher plate 47 being mounted at the lower right hand end, in position to feed this new block 31 up ramp whenever desired.

Fail Safe Feed Screw Operation

As the last sheets are fed from the previous feed block to the left of pusher plate position 47A, drive plates 62 have reached their upper terminal position. Two sensor switches 87 and 88 are illustrated directly below the pusher plate 47A in the terminal position in FIG. 2, the right hand one of these, switch 87, being a deceleration sensor switch assuring that the feed screw rotation will be reduced to a very slow forward feed as soon as deceleration sensor 87 is actuated by the arrival of drive carriage 51 in contact with its sensor arm, and simultaneously a flashing light is initiated, warning of impending runout of the paper sheet supply. The second or left one of these switches is a stop sensor 88, and the arrival of the drive carriage 51 at the position where it actuates the sensor arm of stop sensor 88 opens the switch therein and cuts off forward feed rotation of feed screw 57, also changing the flashing light to a continuous light indicating the actual out of paper condition.

Thereafter, upon command, the feed screw may be rotated in its reverse direction causing the drive carriage 51 to move down the slanting feed screw, disengaging hooks 64 from the pusher plate at its terminal position 47A. The pusher plate 47A may then be removed and continuing reverse rotation of feed screw 57 merely depress hooks 64 under block 31, as indicated in position 62A shown in solid lines in the central portion of FIG. 2 and in dot-dash lines in FIG. 3, with hooks 64 depressed beneath the upper surface of ramp 29.

At the right hand end of FIG. 2, the new pusher plate 47 is shown standing on ramp 29, with its shorter arm 49 extending underneath a stop bar or stop post 89, and its taller arm 48 standing up ramp from stop post 89 and in abutting engagement therewith. The pusher plate 47 may be placed in this position like a sheet metal bookend while multiple reams of paper are placed edgewise on ramp 29 leaning against pusher plate 47. Successive reams are stacked, progressively arrayed in the up ramp direction, until the entire block 31 is loaded on ramp 29, as indicated in FIG. 2. While the previous singulated and shingled sheets from the previous feed block 31 are being delivered to the counterbalanced infeed tray, this retracting repositioning of the drive carriage 51 can be initiated and often completed in a very short period of time.

When the drive carriage 51 reaches the lowermost position indicated at the right hand end of FIG. 2, two further limit switches are actuated, the deceleration sensor 91 and stop sensor 92, performing functions similar to sensors 87 and 88 at the upper end of ramp 29.

In its lowermost stopped position, shown at the right hand side of FIG. 2, the hooks 64 have cleared the underside of block 31 and pusher plate 47, and the springs 66 have raised side plates 62 above the level of ramp 29 in the down ramp position beyond pusher plate 47 as illustrated in FIG. 2.

Actuation of motor M, located beneath the lower end of ramp 29 in the short end column 28, to produce resupply feed advance rotation of feed screw 57 advances the drive carriage 51 with side plates 62 deploying hooks 64 into engagement with flange 49 of pusher plate 47. As a result, pusher plate 47 is driven slowly up ramp 29 until the uppermost feed end of feed block 31 reaches the position where the first sheets of the feed block are ready for singulation and shingling in the remaining subassemblies of this invention.

At the lower or loading end of the high capacity sheet feeder 21 shown in FIG. 2, the feed screw 57 is shown supported in a bearing 93 mounted on an end wall 94 of the overall assembly, upstanding from a lightweight base panel 96 underlying the feed screw 57 and guide rod 52 along the entire path of travel of drive carriage 51 from the lower loading edge of ramp 29 shown in FIG. 2 to the upper feed end of the ramp at the upper left hand end of FIG. 2. The bearing 93 mounted on end wall 94 is mounted in a sacrificial bearing mount, a lightweight sheet metal centering cup, designed to hold feed screw 57 in its desired position during all normal operations with normal feed loads. If any unusual friction or jamming interference of parts produces endwise translation of feed screw 57, this sacrificial cup bearing mount for bearing 93 automatically inverts and breaks loose from end wall 94, avoiding any damage to the more valuable machined parts such as the feed screw, the drive carriage 51 and its related subassemblies, the side plates, the pusher plate 47 or any of the sensors 87, 88, 91 and 92. Any such unusual friction or interference occurring at the upper end of the travel of carriage 51 along feed screw 57 near the upper feed end of ramp 29 will produce the same result, with breakaway protection for the valuable component parts of the device. When repairs or adjustments are completed, a new sacrificial bearing mount securing bearing 93 in end wall 94 allows the entire assembly to be reassembled and restored to operation readily.

Feed Mechanism for Individual Sheets

Figure 6:
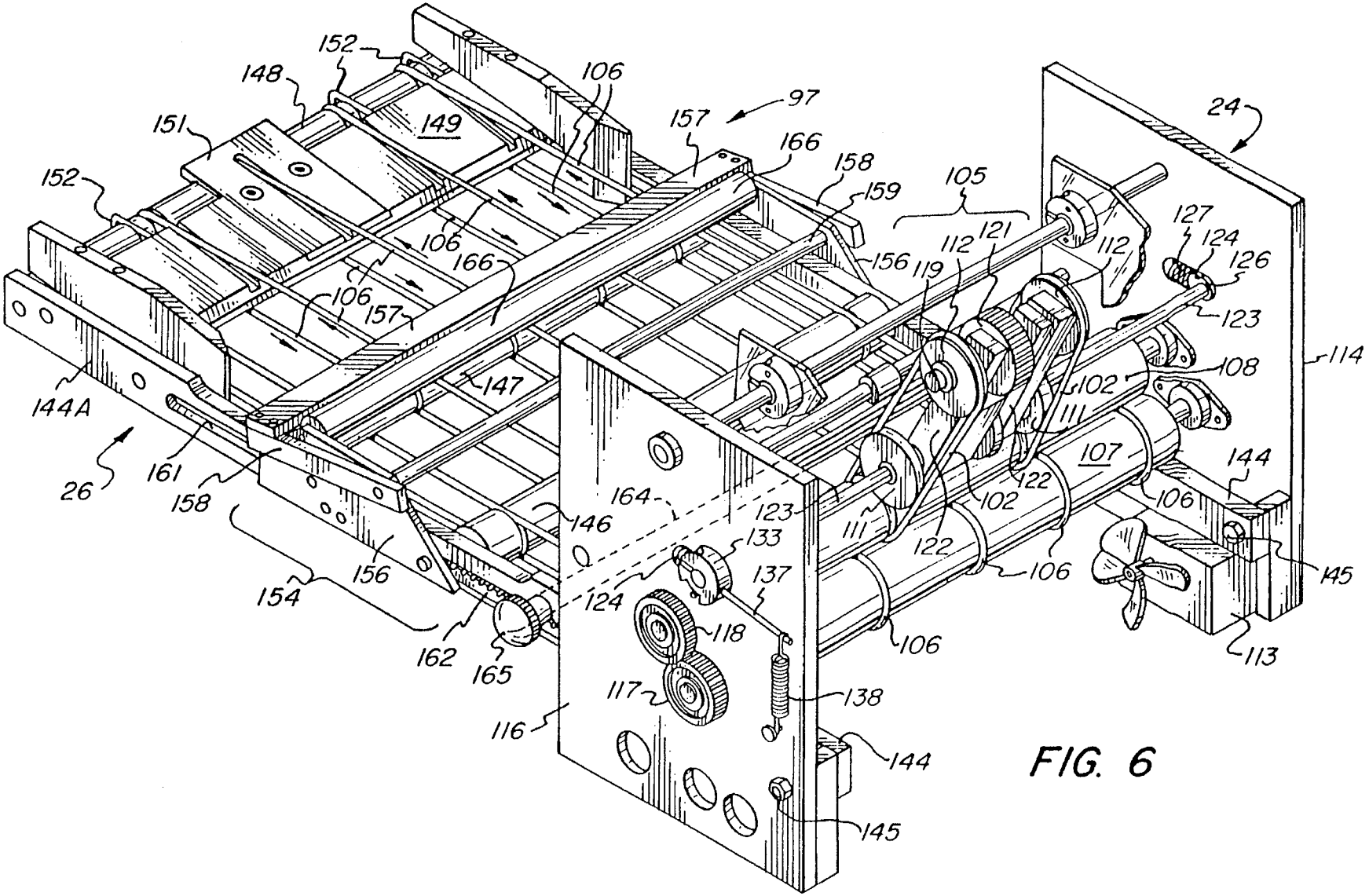
FIG. 6 is a perspective view of the singulating shingling mechanism of the device for delivering fresh sheets to the underside of the sheet stack on the counterbalanced infeed tray platform of the feeder.
Figure 7:
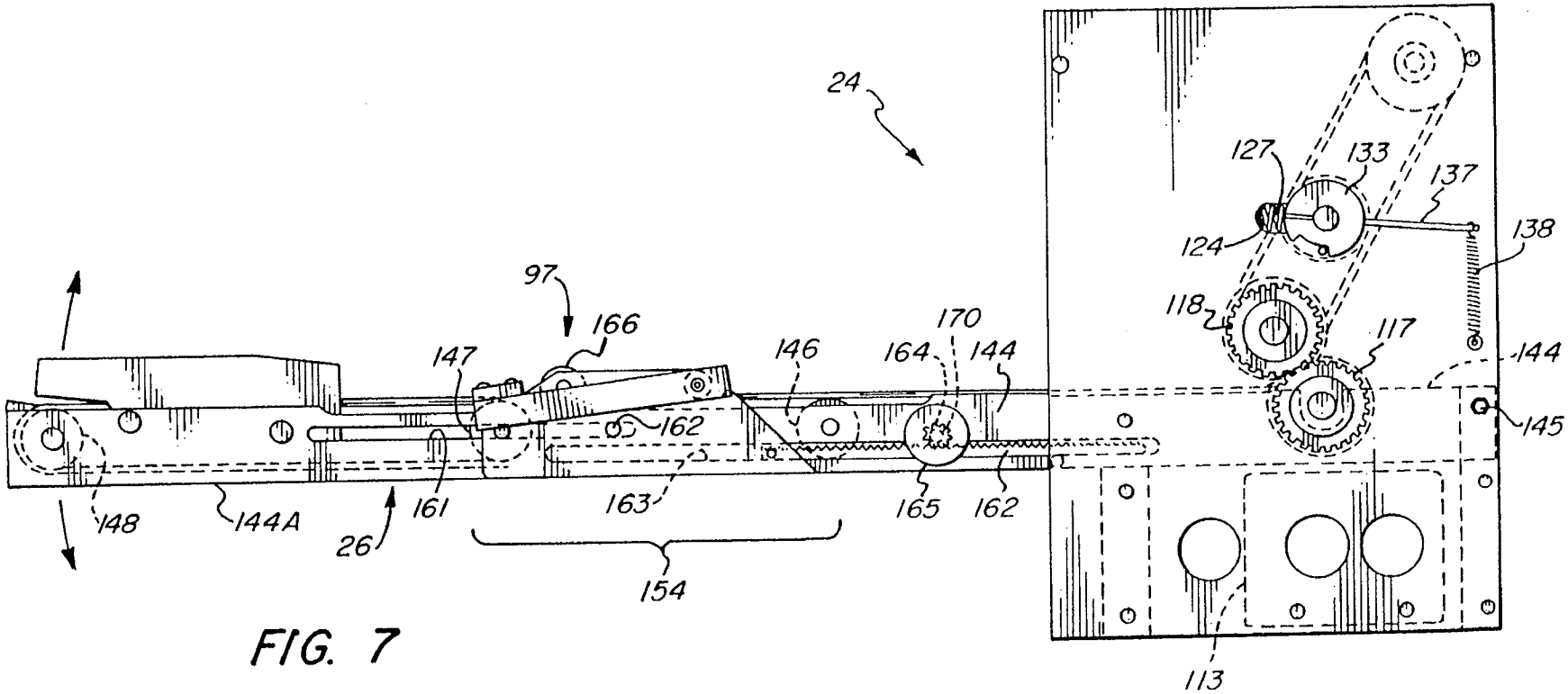
FIG. 7 is a front elevation view of the same singulating shingling mechanism.

The singulator shingling mechanism 24, the counterbalanced infeed tray 26 and the sheet stream feeder 97 are shown in the fragmentary perspective view of FIG. 6, and they are also seen in the upper central portion of FIG. 1 between the sheet feed block 31 and the printer 27. In addition, the side view of FIG. 7 shows the side elevation of these subassemblies in their cooperating relationship.

Singulating Feed Assembly

As the frontmost sheet 104 of the feed block 31 arrives at the upper end of ramp 29, it is thus delivered into abutting contact with a singulating feed assembly 105 shown in FIG. 6 and in more detail in FIGS. 7, 8, 9 and 11–13. This feed assembly drives the singulating belts 102 to strip each frontmost sheet 104 in turn from feed block 31 and drive it downward into the sheet stream feeder 97. In addition, the singulating feed assembly 105 is articulated, and provided with two limit switches governing the feed screw operation to advance the feed block 31 into its feed position, and alternatively to cut off feed and shut down the entire device as an emergency stop condition if the feed block 31 is moved too close to the singulating feed assembly creating a risk of jamming. Removal of a few sheets from the frontmost portion of feed block 31 then reinitiates normal feed operation.

Figure 10A:
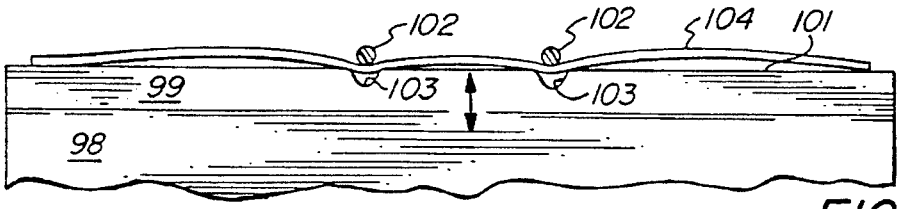
FIGS. 10A and 10B are fragmentary cross-sectional views taken along the planes 10A—10A and 10B—10B in FIG. 9, both substantially perpendicular to the advancing sheets as they are singulated by the device.

The block of sheets 31 delivered up ramp 29 to the singulating feed assembly 105 arrives on a delivery deck 98 having a downward slanting deck ramp 99 ending at a terminal deck edge 101 closely adjacent to a pair of round polymeric singulating belts 102. Smooth rounded notches 103 are formed in deck edge 101 to accommodate singulating belts 102, and the deck 98 is adjustable over a short range of motion toward and away from belts 102 to vary the space between the singulating belts 102 and the depth of notches 103. Slight intrusion of singulating belts 102 into the notches 103 has the effect of causing an arching or buckling shape of the frontmost paper sheet 104 in direct contact with the singulating belts 102, as shown in FIG. 10A and this frontmost sheet 104 is thus slightly arched, with a central arched portion spaced very slightly away from deck edge 101, and also with outer arched portions spaced slightly away from deck edge 101, with the singulating belts 102 depressing two tractive portions of frontmost sheet 104 into the mouth of the respective notches 103 in the deck ramp 99.

Figure 10B:
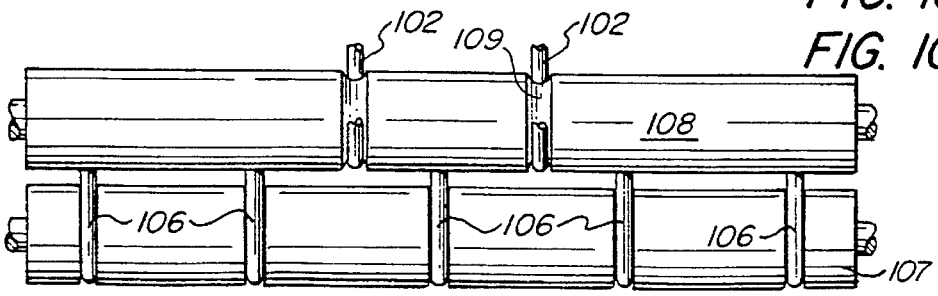

This arching or buckling configuration of frontmost-sheet 104 assures that any fibre-lock adhesion between frontmost sheet 104 and the following flat sheets directly behind it will be broken by the presence of air molecules between these sheets, assuring the effective singulation of each frontmost sheet in turn as it is contacted by singulating belts 102 and driven downward toward feed belts 106 passing around a nip roller 107 directly beneath delivery deck 98 and deck ramp 99. As indicated in FIG. 10B, a plurality of five feed belts 106 are employed to receive and advance each frontmost sheet 104 in turn as it descends downward between feed block 31 and singulating belts 102.

Singulating belts 102 are preferably circular in cross section and may be termed "O-belts", and feed belts 106 may likewise be "O-belts" as illustrated in the figures.

Singulating belts 102 are positioned encircling a guide roller 108 closely adjacent to nip roller 107 and extending laterally across the entire width of the sheets in feed block 31. Suitable guide grooves formed in guide roller 108 accommodate these singulating belts 102 and the guide grooves 109 are deep enough to receive the entire diameter of belts 102 and actually allow the belts travelling around guide roller 108 to be recessed beneath the roller's periphery as indicated in the figures, assuring that each frontmost sheet 104 in turn will travel around guide roller 108 without wrinkling. Thus, as indicated in FIG. 9, the sheet 104 is gripped between the plurality of feed belts 106 and the periphery of guide roller 108 as it passes between the two rollers 107 and 108.

Figure 9:
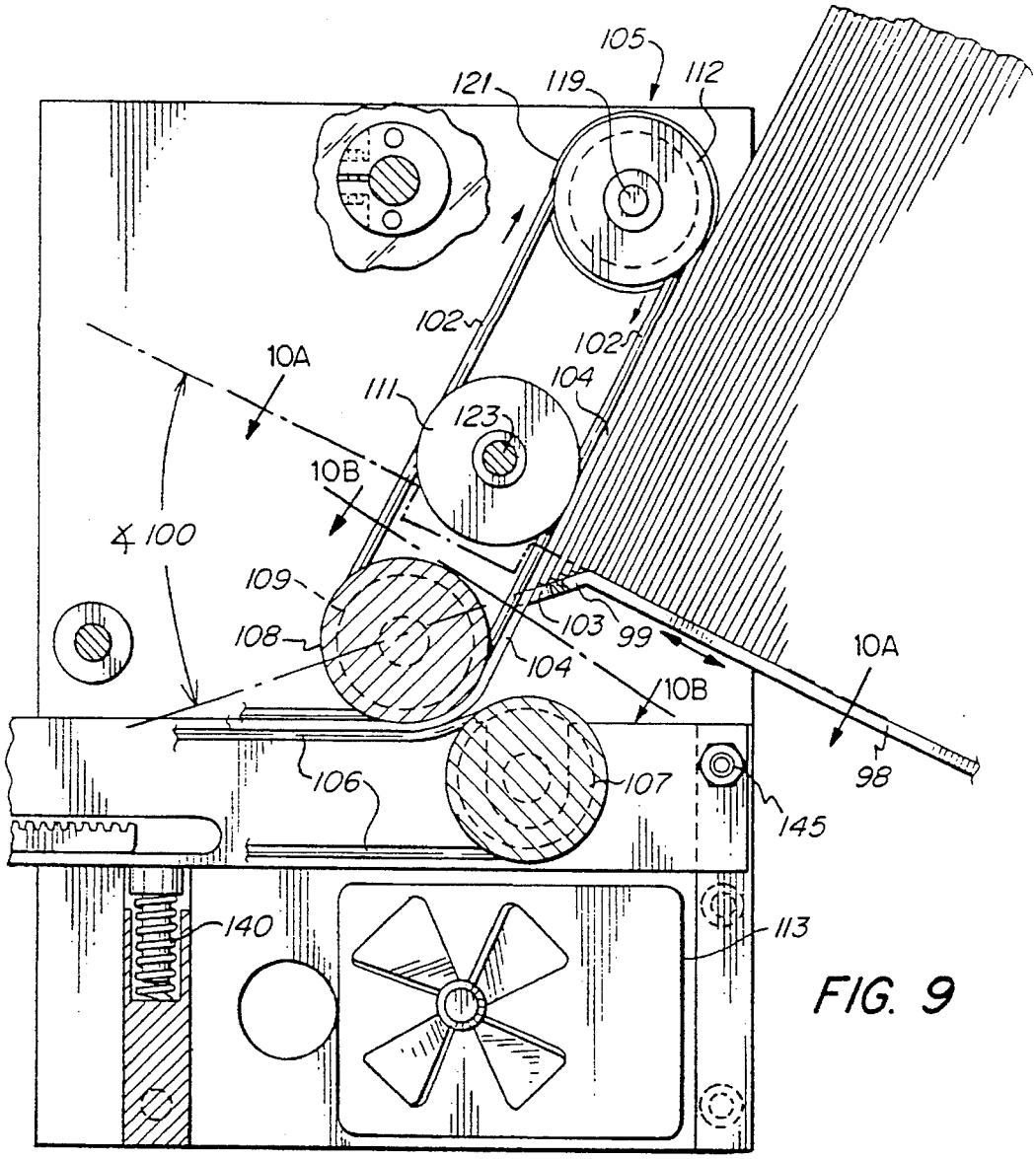
FIG. 9 is a fragmentary cross-sectional front elevation view of the same mechanism receiving individual sheets delivered by the high capacity sheet feeder, showing the singulating operation of the device.

As indicated in FIG. 9, the two singulating belts 102 travel in a clockwise direction around roller 108 and they each pass an intermediate idler sheave 111 as they travel upward to encircle an upper pressure sheave 112. The two pressure sheaves 112 and a slightly oversize central feed roller 121 are all mounted on a stud shaft 119 at the top of singulating feed assembly 105. The arriving feed block 31 of stacked paper sheets delivers frontmost sheet 104 into direct contact with feed roller 121 and belts 102 on pressure sheaves 112, as clearly illustrated in FIG. 9.

In the perspective view of FIG. 6, the full width rollers 107 and 108 may be compared to the idler sheaves 111 and pressure sheaves 112 which are merely wide enough in an axial direction to receive and guide the singulating belts 102. Also clearly shown in FIG. 6 and 7 are the mating gears drivingly joining the nip roller 107 and the guide roller 108 for pinch roll type engagement at matched angular speeds. Driving torque for these rollers 107 and 108 is supplied by a feed drive motor 113 positioned beneath nip roller 107 and mounted on the inner face of a rear pedestal plate 114 on which are mounted the bearings supporting the shafts of rollers 107 and 108 as shown in FIG. 6. A timing belt drive 115 connects the shaft of motor 113 to the shaft of nip roller 107.

A front pedestal plate 116 supports corresponding shaft bearings for rollers 107 and 108 and the short lengths of the roller's shafts extending beyond the outer face of front pedestal plate 116 provide keyed mountings for the drive gears 117 and 118 drivingly joining the rollers 107 and 108 together for matched angular velocity.

A stud shaft 119 provides the rotational mounting for the upper pressure sheaves 112 and the slightly oversized feed roller 121, formed of a soft tractive polymer material, whose diameter is slightly greater than the diameter of singulator belts 102 as they pass around their respective upper pressure sheaves 112. Thus, as indicated in the figures, the feed roller 121 comes in contact first with the frontmost sheet 104 being delivered on the delivery deck 98, just before this sheet 104 reaches singulator belts 102.

Stud shaft 119 is journalled in a pair of upstanding yoke arms 122 whose opposite lower ends are pivoted on a transverse pivot shaft 123 extending across the entire width of the singulator shingling mechanism 24, and both ends of the pivot shaft 123 are resiliently mounted for horizontal movement in mounting slots 124 accommodating sliding bearing blocks 126 in which the pivot shaft 123 are mounted. As indicated in the drawings, compression coil springs 127 positioned in the mounting slots 124 resiliently urge bearing blocks 126 toward the feed block 31 as indicated in detail in FIG. 8.

The diagonal upstanding position of yoke arms 122 is thus determined by the resilient positioning of shaft 123. This positioning presents singulating belts 102 in the position required for singulating and feeding frontmost pages 104 into the nip between rollers 107 and 108, and at the same time the mechanism mounted on resiliently biased shaft 123 performs a number of control functions governing the operation of the entire assembly.

Figure 12:
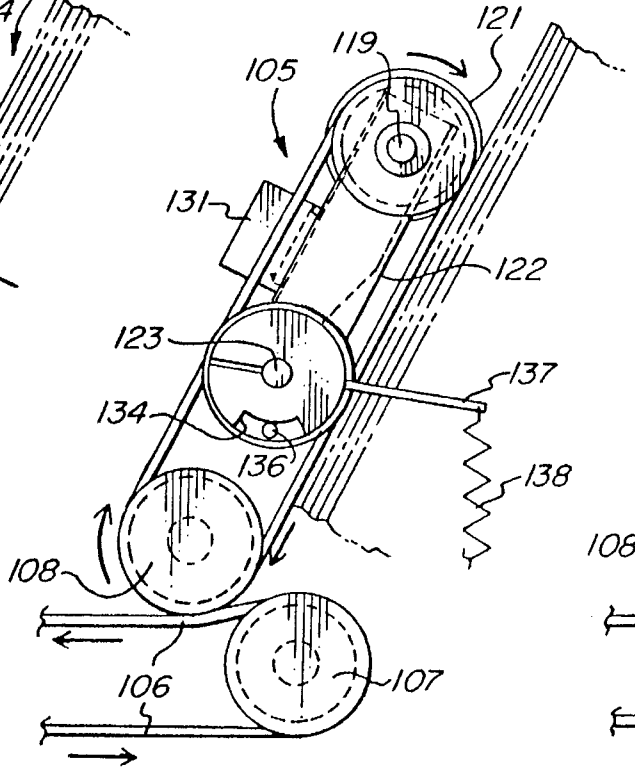
Figure 11:
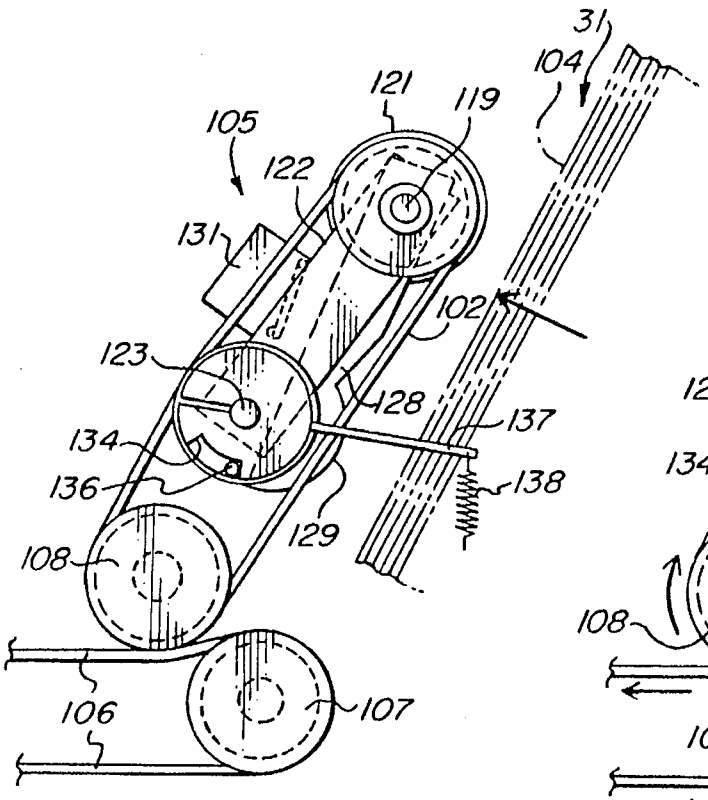

The two yoke arms 122 are preferably rectangular in shape, and are keyed at their lower ends to pivot shaft 123, and a stud shaft bore at their upper ends in which stud shaft 119 is journalled. The rectangular shape of these yoke arms 122 is shown in FIGS. 11 and 12 and also indicated in FIG. 6.

Automatic Ramp Feed Control

Pivotally mounted on stud shaft 119 and depending therefrom on the feed block 31 side of pivot shaft 123 is a feed start finger 128. At any time the sheet feed block 31 is not in position with its frontmost sheets abutting the feed roller 121, feed start finger 128 depends downward and forward toward the feed block with a sensing surface 129 positioned to provide the second contact of the singulating feed assembly 105 with the advancing feed block 31, immediately after first contact with feed roller 121. This is indicated in FIG. 11, where frontmost sheet 104 is shown approaching feed roller 121 and sensing surface 129 of feed start finger 128 depending downward from stud shaft 119. Feed advance of the block 31 continues until feed start finger 128 has been depressed clockwise about stud shaft 119 to the position shown in FIG. 12, where surface 129 has now withdrawn into alignment with singulating belts 102 and feed roller 121 carried by yoke arms 122 pivoting with shaft 123 on bearing blocks 126 and a resupply feed advance switch 131 mounted on an arm 122 has had its actuating arm depressed by this counterclockwise movement of start finger 128 to close the switch 131 and terminate resupply feed advance motion of the feed block 31, as shown in FIG. 12 as compared with FIG. 11.

In this position, with frontmost sheet 104 in contact with feed roller 121 and singulating belts 102, normal feed can progress and the frontmost sheets can be fed sequentially into the sheet stream feeder 97. A ratcheting resupply mechanism for incremental feed advance of feed block 31 is provided by a resupply sensor switch 131 mounted on yoke arm 122, with its actuator arm free for movement toward feed block 31 and away from sheet stream feeder 97. Each end of shaft 123 has keyed thereon an aligned switch actuator cam 133 having a sector cutout 134, subtending approximately 80 degrees along its lower edge beneath shaft 123, engaging a stationary pin 136 protruding from the adjacent face of the pedestal plate 114 or 116 into engagement with the sector cutout 134. Each cam 133 has a spring arm 137 extending radially therefrom biased downwardly by a tension spring 138 whose lower end is anchored to the adjacent pedestal plate.

Figure 8:
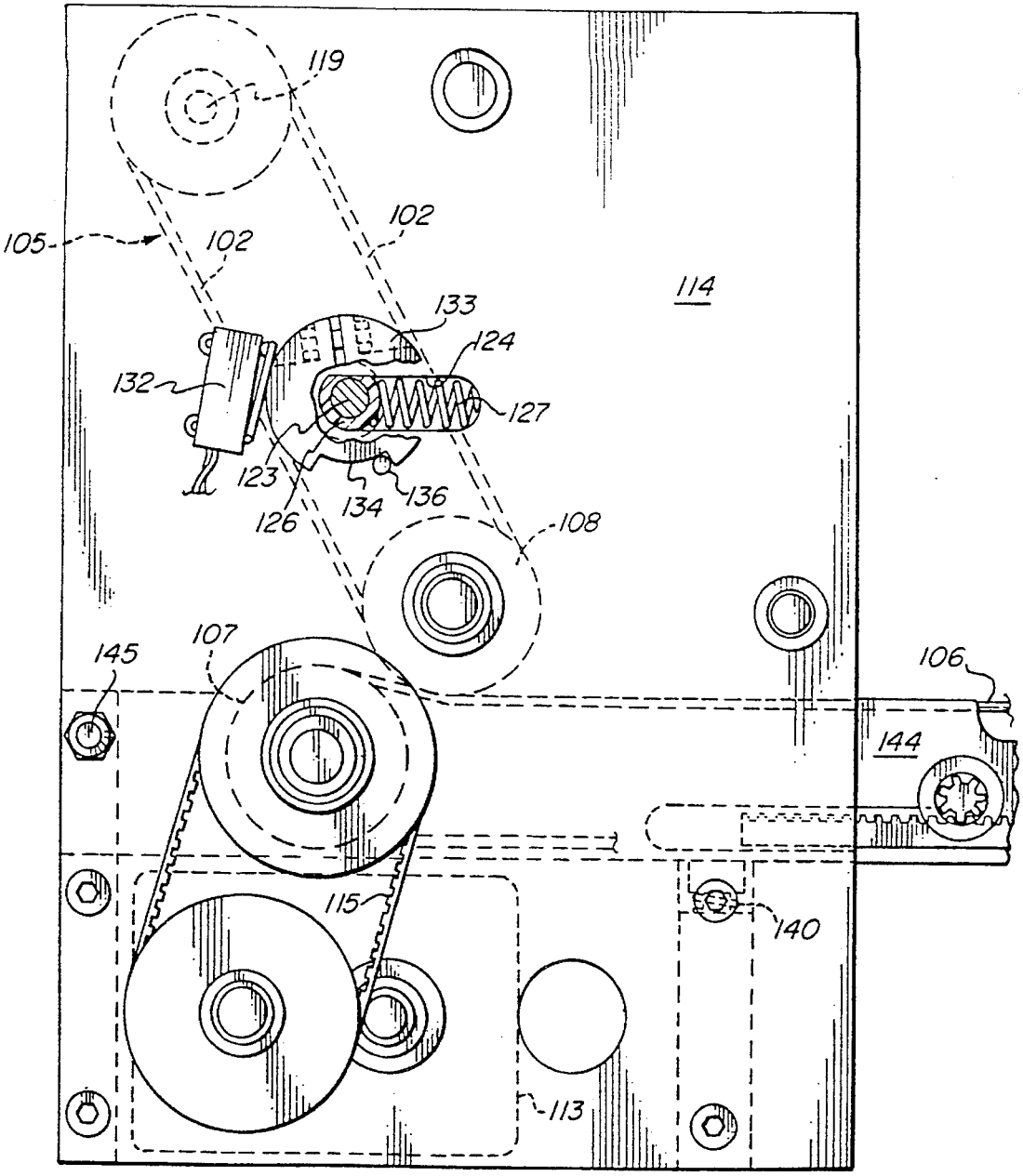
FIG. 8 is a fragmentary greatly enlarged rear elevation view of the same singulating shingling mechanism.
Figure 13:
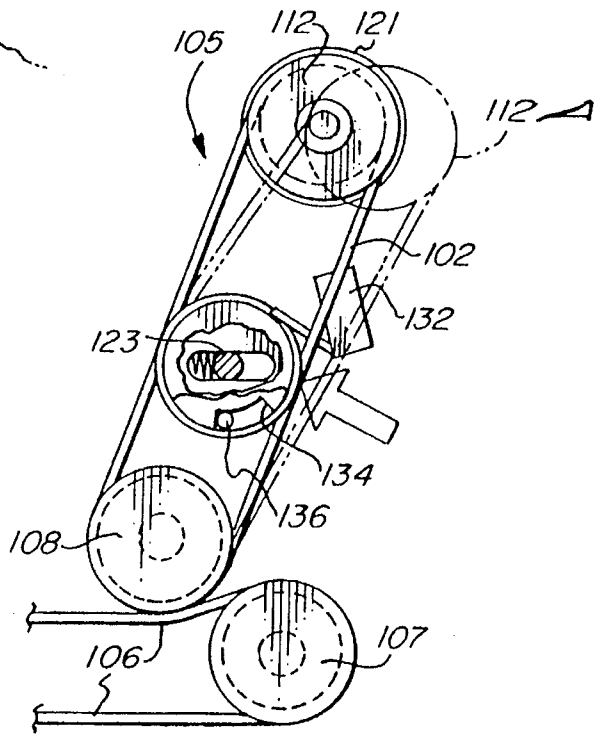
FIGS. 11, 12 and 13 are fragmentary schematic cross-sectional front elevation views of the feeder belt drive mechanism showing the operation of two different limit switches designed to actuate the drive and to deactivate the feed advance before overfeeding has occurred.

A comparison of FIGS. 8, 11, 12 and 13 shows that in the feed advance mode of FIG. 11 up to the point where normal feed operation begins in FIG. 12, the resupply sensor switch 131 is unactuated to assure normal feed screw resupply operation. As can be seen by comparing the positions of spring arm 137 and spring 138 in FIGS. 11 and 12, the feed roller 121 is in constant pivotal "tension" with foremost sheet 104 of the feed block 131. If the feed advance of feed block 31 would move singulating feed assembly 105 toward the printer 27 and away from the ramp 29, as shown in FIG. 12. As this motion begins, cam 133 has the forward end of its sector slot 134 engaging pin 136 as shown in FIGS. 8 and 13.

As such feed continues to advance, causing shaft 123 journalled in sliding bearing blocks 126 to be displaced in slot 124, each cam 133 is pivoted about pin 136 and each spring 127 is depressed, causing shaft 123 to pivot further and moving the spring arm 137 protruding forwardly from cam 133 to rotate upward even further, stretching tension spring 138 secured between the outer end of spring arm 137 and the pedestal plate beside it as indicated in FIGS. 6, 7, 11 and 12.

Spring 138 is shown drawing spring arm 137 downward in FIG. 7 in the position it occupies as feed block 31 first comes in contact with feed roller 121 of singulating feed mechanism 105. As feed block 31 advances and spring arm 137 is raised to the position shown in FIG. 12, stretching spring 138, the cam 133 pivots on its keyed shaft 123 to the position shown in FIG. 12.

Further advance of feed block 31 causes the entire singulating feed assembly 105 to move counterclockwise to the position shown in FIG. 13, and resupply safety stop switch 132 is opened by the withdrawal of cam 133 from the switch's actuator arm, as indicated in FIG. 13 stopping supply motor M located within column 28 and preventing damage to the system. Manual removal of a sufficient number of frontmost sheets 104 from feed block 31, or manual reversing torque applied to a crank 60 extending from the lower end of feed screw 57 (FIG. 2), causes singulating feed assembly 105 to swing back clockwise under the influence of springs 127 and 138 from the position of FIG. 13 to the normal feed positions indicated in FIGS. 8 and 12, closing switch 132 and again permitting free oscillation of assembly 105 and shaft 123, and initiating resupply feed advance of block 31. This intermittent operation of feed advance via feed screw 57, controlled by switch 131, start finger 128 and constant pressure of feed roller 121 controlled by spring 138, assures an ample supply of frontmost sheets 104 for substantially continuous operation of the entire feed device.

The sensor switch 132 serves as a safety stop switch; if feed screw 57 delivers feed block 31 in the feed advance direction to the point where an excess supply of papers sheets is in position, the automatic pivoting angular movement of singulating feed assembly 105 shuts down the motor M housed within column 28, stopping feed screw 57 until any such oversupply movement is corrected.

In addition to this articulating feed control movement of singulating feed assembly 105, it should be noted that an additional adjustment of the sheet feeding operation is provided by the adjustable positioning of deck ramp 99 toward and away from the singulating feed assembly. This adjustable movement of the deck brings deck edge 101 closer to or farther away from singulating belts 102 and feed roller 121.

Thus, the notches 103 straddle the singulating belts 102 to greater or lesser degree. Since the tension of the belts 102 is constant and the distance between tangent contact of guide roller 108 and idler sheave 111 is also constant, the frontmost sheet 104 being urged downward by feed roller 121 has to exert greater force to displace singulator belts 102 from their notches 103 to permit sheet 104 to pass through. The force required is directly proportional to the tension in the singulator belts 102 and their engagement in notches 103, and inversely proportional to the distance between roller 108 and sheaves 111, and also to the angle 100 between the deck ramp 99 and deck 98, which angle may be adjusted or varied to suit particular applications.

The slightly greater diameter of roller 121, as compared with the diameter of upper pressure sheaves 112, provides a slightly greater linear velocity of the rim of roller 121 as it urges frontmost sheet 104 downward, enhancing the buckling or arching of sheet 104 as illustrated in FIG. 10A and assuring that the fibre-lock bond between frontmost sheet 104 and the sheet directly behind it will be effectively broken during the singulating operation. Deck adjustment allows fine tuning of the effect of this velocity difference for optimum singulating operation.

Sheet Stream Feeder Mechanism

Figure 14:
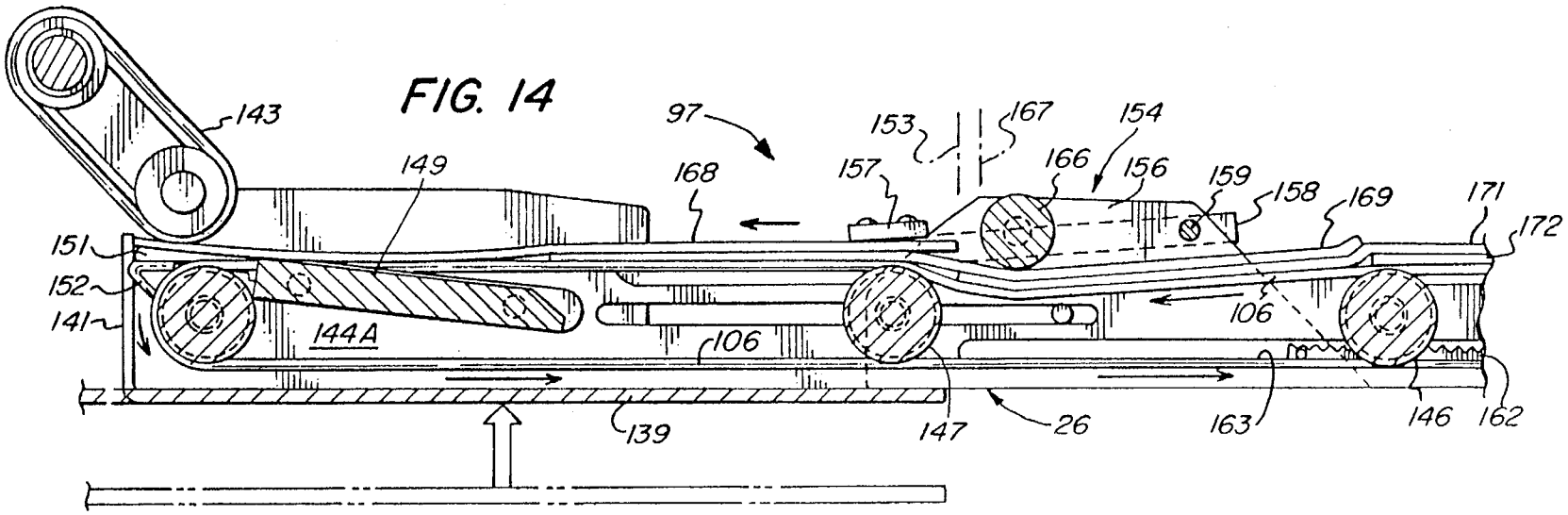
FIG. 14 is a fragmentary front elevation view of the delivery portion of the singulating shingling mechanism delivering fresh sheets to the underside of the sheet stack on the counterbalanced infeed tray platform of the feeder.

The sheet stream feeder mechanism 97 indicated in FIGS. 1, 2, 6 and 7 forms the output or delivery end of the high capacity sheet feeders of the present invention. This sheet stream feeder is designed for cooperation with and is supported on the counterbalanced infeed platform 26 of the high capacity feeders, as illustrated in FIG. 1. Illustrated schematically in FIG. 14 is an elevator tray 139 of machine 27 for holding a plurality of sheets of paper, provided with a feed stop 141. The sheet stream feeder 97 of the present invention constitutes a customized conveyor for delivering new paper sheets in a shingled stream which are added to the underside of a feed stack 142 of sheets presented for intake feed to the high volume printer 27 of FIG. 1.

Figure 15:
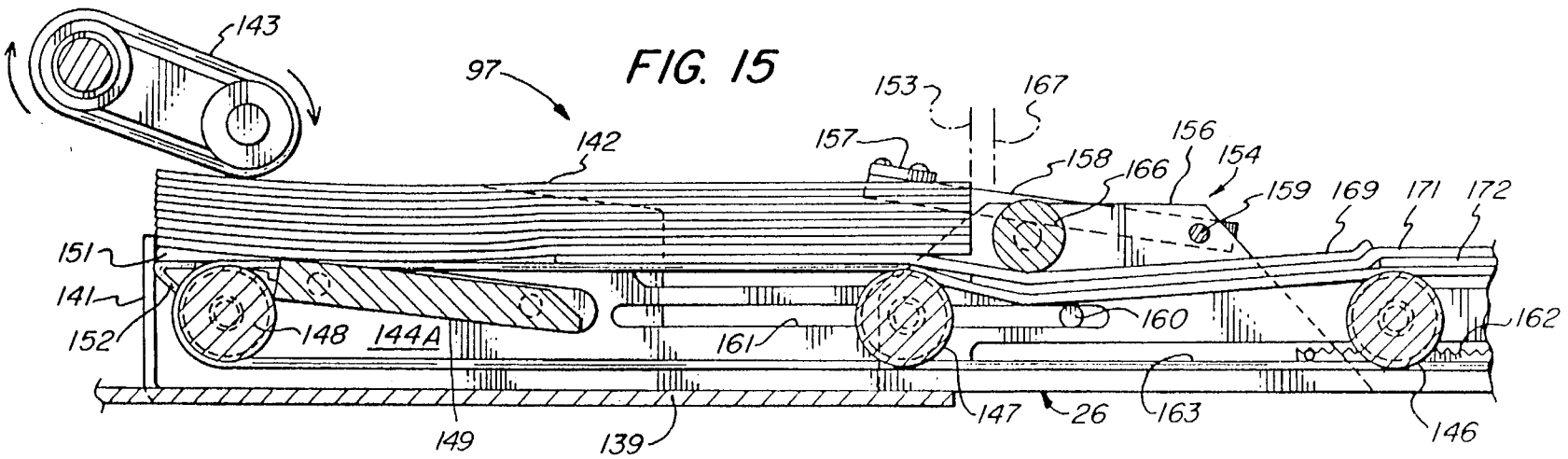
FIG. 15 is a corresponding fragmentary front elevation view of the same mechanism after a suitable stack of sheets has been fed to the underside of the same sheet stack.

Printer 27 is provided with printer feed belt means 143 shown in FIGS. 14 and 15 positioned to engage tractively and draw into the printer 27 in rapid succession the uppermost sheets from stack 142 on feed tray 139. Sheet stream feeder 97 is mounted on counterbalanced platform 26, constructed between a pair of cantilevered arms 144 whose proximal ends are pivoted about pivots 145 at the insider lower portions of the pedestal plates 114 and 116, near ramp 29, as indicated in FIG. 6. The distal ends 144A of arms 144 protrude lengthwise toward the left in FIG. 6 for resting engagement directly on elevator tray 139, as indicated in FIGS. 14 and 15, with their outermost ends contacting stop 141. Counterbalancing compression coil springs 140 support the weight of arms 144, being compressed between arms 144 and the lower portions of the pedestal plates 114 and 116, toward distal ends 144A.

First, second and third feedbelt rollers 146, 147 and 148 are all idler rollers, journalled for rotation in the cantilever arms 144, with their spaced grooves receiving the feedbelts 106 which are tractively driven by nip roller 107, rotated by timing belt 115 driven by motor 113 as shown in FIG. 8. Thus the feed belts 106 pass over the motor driven nip roller 107, beneath guide roller 108. In FIGS. 6 and 7, the driving nip roller 107 and the three feed belt rollers 146, 147 and 148 are shown arrayed from right to left, extending from the singulator feed assembly 105 to the distal end of the sheet stream feeder 97, with five endless feed belts 106 shown travelling around all of these rollers and back for a complete circuit forming a conveyor belt for the stream of singulated paper sheets being delivered to printer 27.

A sheet support plate 149 spans the distal end of the assembly between the two cantilever arms 144A, slanting gently upward with grooves accommodating belts 106 to provide a final support surface at the terminal end of the feed path on which the arriving sheets rest. A protruding central support ledge 151 spans the central portion of this plate 149 and the central feed belt 106 passes through a slot in ledge 151 and hence downward around the third feedbelt roller 148, leaving each sheet delivered by the belts 106 in turn resting upon support plate 149 and its support ledge 151.

Flanking the central support ledge 151 are several stripper fingers 152 extending forward beyond third feedbelt roller 148 and assuring that arriving sheets will not be wrapped around the feedbelt roller 148 and carried under it back toward the feed assembly on the underside of the sheet stream feeder 97. Stripper fingers 152 and support ledge 151 thus present the leading edges of all of the sheets in feed stack 142 with a slight upward slant, as indicated in FIG. 15, and this promotes the smooth even operation of printer feedbelts 143 in drawing each uppermost sheet in turn from stack 142.

Singulated Shingled Sheet Stream Feed Control

As stack 142 is built up by the deliver of fresh sheets to its underside, as indicated in FIGS. 14 and 15, the leading edges of the stack are determined by stop 141 and the trailing edges of the sheets in the stack are all aligned along a vertical rear edge plane 153. Counterbalanced platform 26 supporting the sheet stream feeder 97 is a two-part structure, with a central sliding carriage 154 supporting second feedbelt roller 147 at a selected one of a variety of adjustable positions between rollers 146 and 148. This carriage 154 is shown in FIGS. 6, 7, 14 and 15, where it will be seen that carriage walls 156 flanking the cantilever arms 144 are joined to each other by the roller 147, whose ends are journalled respectively in each of the two carriage walls 156, and also by a feedbar assembly. This comprises a level sensor bar 157 spanning the entire width of feeder 97 above second feedbelt roller 147, and pivotally mounted on pivot arms 158, positioned outside walls 156. Arms 158 are joined to each other by a transverse shaft 159 whose ends extend through journal mountings in plates 156 to be keyed to pivot arms 158. Bar 157 and arms 158 thus form a pivoting structure, which allows level sensor bar 157 to swing up and down about the axis of transverse shaft 159, and to rest on the uppermost sheet of stack 142 near the trailing edges of the stack close to rear edge plane 153, as indicated in FIGS. 14 and 15.

Sliding lengthwise adjustment movement of carriage 154 is guided by the shaft of the second feedbelt roller 147 slidingly mounted in a longitudinal slot 161 in the cantilever arms 144, as well as by a guide pin 160 protruding inward into the same slot 161 from a central part of the inner face of each carriage wall 156. As shown in FIGS. 6 and 7, an adjustment rack 162 pinned to each of the carriage walls 156 extends rearwardly toward the ramp 29, sliding in a longitudinal slot 163 formed in the cantilever arm 144.

Each rack 162 in its slot 163 is engaged with an adjustment pinion 164, keyed to a pinion shaft 170 extending transversely across the structure between the two rack slots 163, and at least one end of shaft 170 has a manual adjustment knob 165 mounted thereon for operator adjustment of the pinion 164 to drive the rack 162 and the associated sliding carriage 154 toward or away from the end stop 141 at the remote end of the cantilever arms 144A.

Adjustment of the knob and carriage 154 positions level sensor 157 directly over the tailing edge of the sheets in stack 142 and also brings into position a biasing roller 166, journalled spanning the carriage 154 between its two upstanding walls 156, spaced a few millimeters rearwardly from rear edge plate 153, to allow the surface of biasing roller 166 which is closest to rear edge plane 153 to define a biasing plane 167 as indicated in FIGS. 14 and 15. The cross sectional side elevation views of FIGS. 14 and 15 clearly illustrate the operation of biasing roller 166 in depressing the stream of sheets travelling lengthwise from right to left, carried by the feedbelts 106, as they approach the second feed belt roller 147. The trailing edge of the stack 142 stands above the arriving sheets and slightly overhangs roller 147, which is adjusted by operation of the adjustment knob 165 to assure that roller 147 is slightly forward of the rear edge plane 153, leaving the overhand illustrated in FIGS. 14 and 15 under which the leading edge of each arriving sheet is delivered by belts 106.

In FIGS. 14 and 15 the shingled stream of arriving sheets are shown with their curvatures exaggerated to emphasize their respective relationship with each other. Thus, in FIG. 14, the first sheet 168 has already been delivered to being the stack 142 with its leading edge against stop 141 resting on stripper fingers 152 and support ledge 151.

The singulating feed assembly 105 and particularly the relationship of singulating belts 102 and feed roller 121 with deck 98 and deck ramp 99 assure that each new foremost sheet 104 will start its downward travel toward the nip roller 107 before the previous sheet has completed its approach to the nip between the nip roller 107 and guide roller 108.

Thus, a stream of singulated but shingled frontmost sheets 104 is delivered to belts 106, and this shingled stream of sheets is shown in FIG. 14 arriving at biasing roller 166 and sliding beneath the trailing edge of the previous sheet 168. Second sheet 169 is thus shown to be halfway along the underside of sheet 168, and the following sheet 171 is also partially underlying the trailing edge of sheet 169, with the next following sheet 172 similarly extending under the tailing edge of sheet 171.

A later series of sheets 169, 171, 172 are shown in FIG. 15, all being delivered successively to the underside of stack 142 and carried by feedbelts 106 to the stop 141, where they are stripped form the belts and raised by the next following sheet as the stack grows in height from the initial sheet shown in FIG. 14 to the stack of sheets 142 shown in FIG. 15, from which feed printer feed belts 143 successively draw the topmost sheet into the printer 27.

The counterbalanced tray 26 remains stationary from the moment elevator tray 139 raised it originally to bring stack 142 into contact with the printer's feed mechanism 143.

Figure 16:
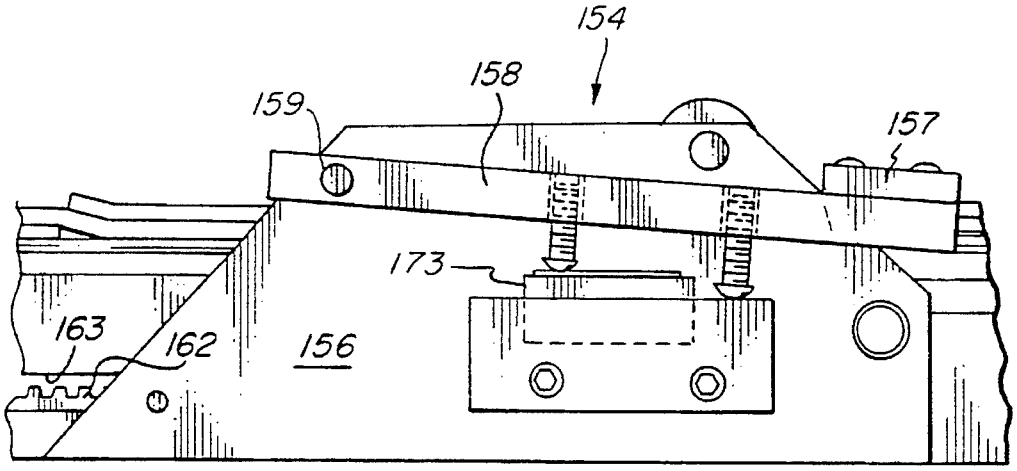
FIGS. 16 and 17 are enlarged fragmentary rear elevation views showing the full stack bar limit switch operation, deactivating the delivery of infeed sheets until the infeed stack has been reduced by normal printer operation.
Figure 17:
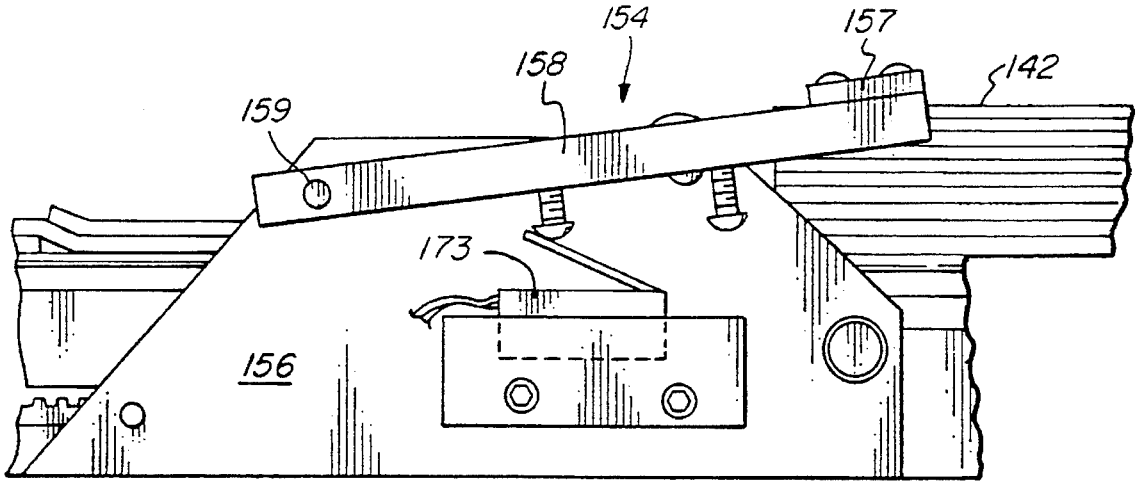

As stack 142 rises, level sensor bar 157 is displaced upward, and when the stack reaches the desired height, as indicated in FIG. 17 as compared with FIG. 16, the resulting angular upward movement of pivot arm 158 beside the rear carriage wall 156 allows a feed sensor switch 173 to open, stopping motor 113 and interrupting the operation of singulating belts 102 and feed belts 106 until the printer has drawn stack 142 down to a point where arm 158 again closes feed switch 173, resuming normal feed operation of the device.

Manual adjustment of the adjustment knob 165 indexing rack 162 along its slot 163 allows the sheet feeders of this invention to accommodate sheets of any required length, such as 11 inch, 13 inch, 14 inch or any other desired length of paper sheets.

Interface With Drawer Loaded Stack Feed Host Machines

The foregoing description relates to a sheet feeder adapted to interface with a printer or other "host" machine having a side mounted sheet stack singulator mechanism. The stack is normally loaded into the printer by opening a panel and placing the stack of sheets on a moving elevator platform that brings the topmost sheet into contact with the singulator. As noted above, Applicant contemplates the use of the sheet feeder according to this invention with printers, photocopiers, and other types of host machines such as the Xerox® model 4090 and IBM models 3827/28 as well as the similar Kodak model 1392 printer that utilize a stack of sheets loaded into a movable drawer with a feed elevator that raises and lowers the stack.

Figure 18:
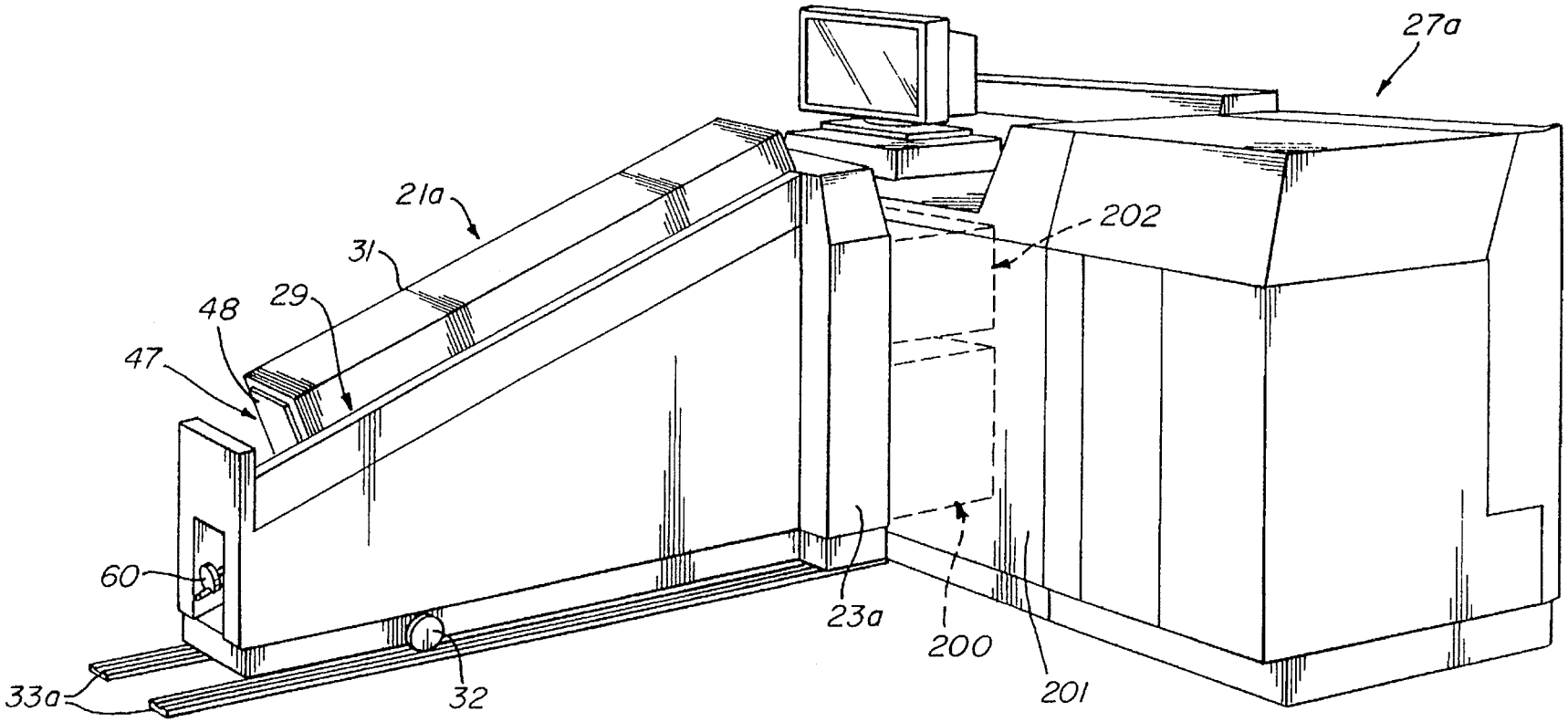
FIG. 18 is a perspective view of a sheet feeder according to an alternative embodiment of this invention interfaced with a drawer-loaded printer.

FIG. 18 illustrates an alternative embodiment of the sheet feeder 21*a* according to this invention adapted to interface with a drawer fed printer 27*a*. The feeder mechanism accesses the lower feed drawer 200 directly through the front of the printer. The printer illustrated herein is exemplary of a Kodak or IBM type printer having an upper drawer 202 and lower drawer 200 along its front side 201. The upper drawer 202 is adapted to hold, for example, 1,000 sheets while the taller lower drawer 200 is adapted to hold, for example, 2,500 sheets. The high speed sheet feeder 21*a* of this embodiment, by accessing the lower drawer 200, allows the user to also manually access and load the upper drawer 202 without interfering with the operation of the sheet feeder 21*a* in the lower drawer 200.

Figure 19:
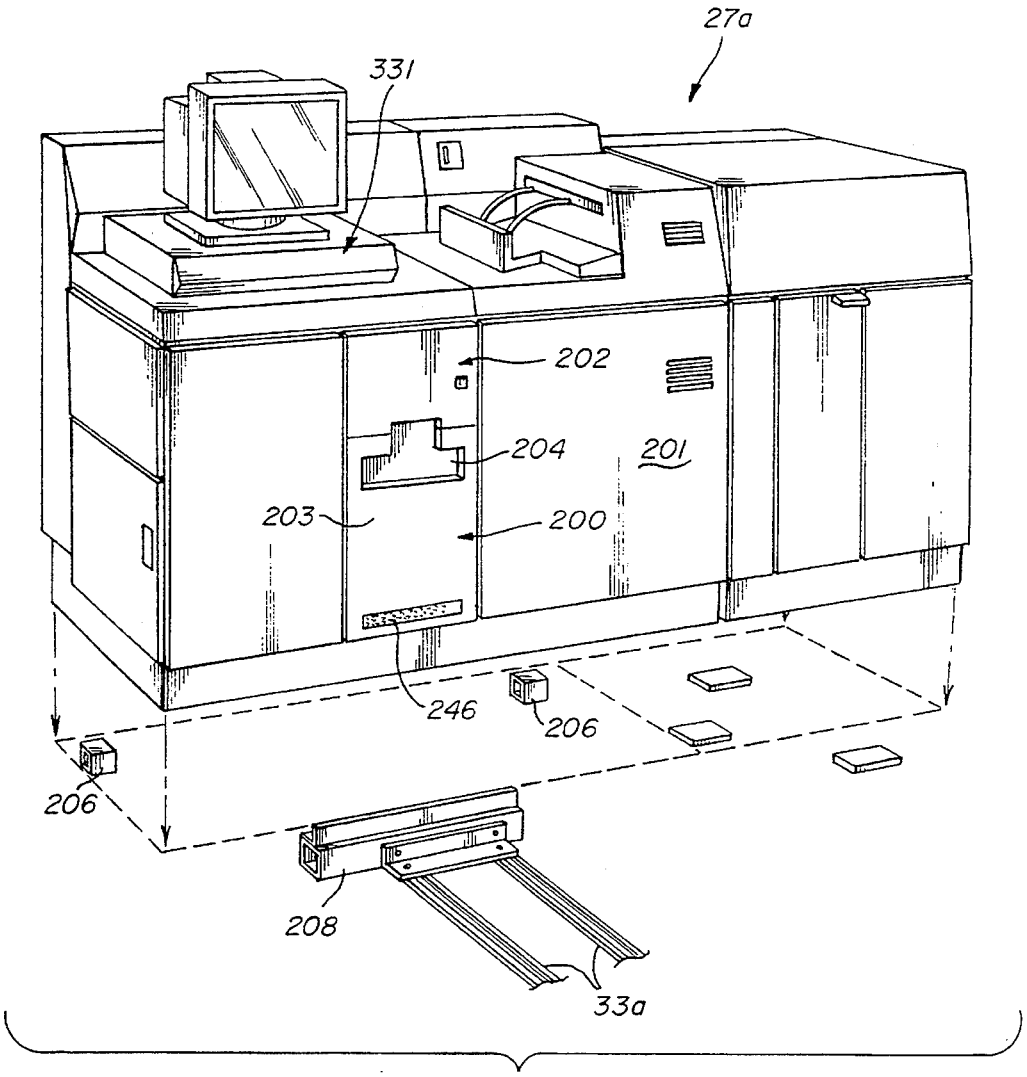
FIG. 19 is a partially exploded perspective view of the exterior of the printer of FIG. 18 adapted to interface with the sheet feeder according to this embodiment.

FIG. 19 further details the printer. As will be described further, the lower drawer 200 has been modified to accept a feeder tray according to this embodiment. The upper drawer 202 can also be modified to accept a feed tray, but for illustration, the lower drawer 200 modification is discussed herein. The lower drawer 200 includes a front 203 and an enlarged portal 204 for accepting the tray. The printer 27*a* is mounted onto a set of blocks 206 that includes a track guide block 208. A set of tracks 33*a* extend outwardly from this block 208 perpendicular to the drawer fronts. The sheet feeder 21*a* moves along this track as detailed in FIG. 18. Unless otherwise discussed, it can be assumed that components are substantially the same in form and function as those described above for the sheet feeder 21 of the preceding embodiment.

Figure 20:
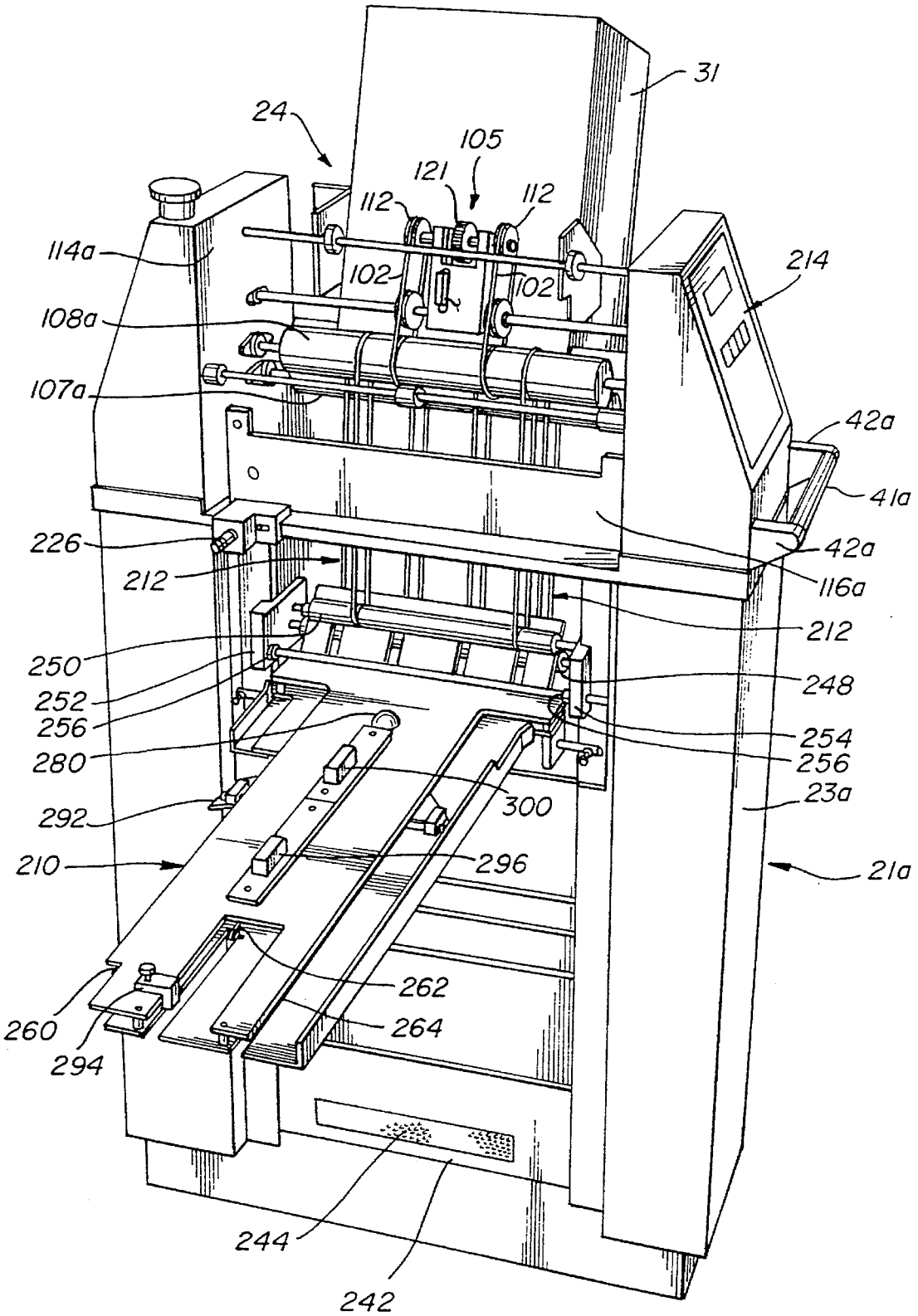
FIG. 20 is a front perspective view of the sheet feeder according to this embodiment.

FIG. 20 illustrates the end view of the sheet feeder 21*a* according to this embodiment. Unlike the embodiment of FIG. 1, the feed tray 210 has been lowered relative to the support column 23*a* so that sheets from the stack 31 can be directed down to the location of the printer's lower drawer 200. Sheets are driven by the singulating feed assembly 105 (which is substantially similar to that described above) down a series of intermediate vertical bridging belts 212 which, in this example can comprise circular cross-section urethane belts into the lowered feed tray assembly 210. As noted, the level of the feed tray 210 relative to the support column 23*a* is chosen to align it with the portal 204 in the printer lower drawer front 203. The sheet feeder controls 214 according to this embodiment can be mounted on the reverse side of the support column 23*a* from those shown for the sheet feeder 21 in FIG. 1. This allows easier manipulation of the controls for the particular printer 27*a* to be interfaced in this example. The controls 214 can be mounted on either side of the column 23*a*, however, depending upon the printer with which to be interfaced. Similarly, the unlocking bar 41*a* and associated pivot arms 42*a* can be reversed compared with the sheet feeder 21 of FIG. 1. Their operation is substantially the same as previously discussed, however.

Figure 21:
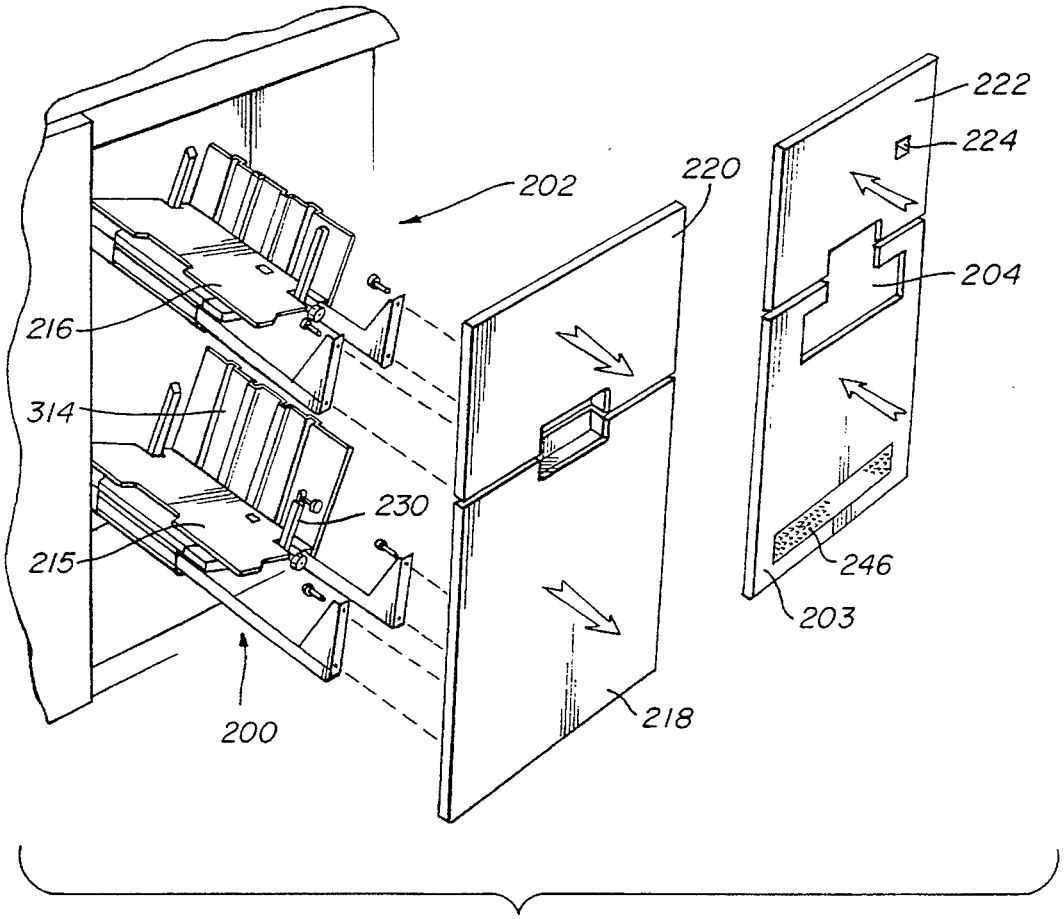
FIG. 21 is a more detailed fragmentary exploded view of the modification to the drawer fronts of the printer according to this embodiment.

FIG. 21 further details the printer drawers 200 and 202. The drawers house moving stack feed elevator platforms 215 and 216 that raise and lower stacks of sheets positioned thereon. The stack feed elevator platforms 215 and 216 are inclined so as to support stacks at an angle (typically 20°) relative to the ground. The standard drawer fronts 218 and 220 normally found upon the printer are replaced with a modified lower front 203 having the portal 204 and modified upper front 222 having a small orifice 224 along its right hand side. The orifice in the upper right hand corner of the upper drawer allows the cylindrical interlock probe 226 (FIG. 20) on the sheet feeder column 23*a* to engage an internally mounted interlock guide block 228 detailed in FIGS. 21A and 21B. The interlock is designed to insure proper alignment of the tray within the printer drawer 200 and can also serve as a safety interlock to prevent accidental pull out of the feed tray 210 from the drawer 200 during operation.

Figure 22:
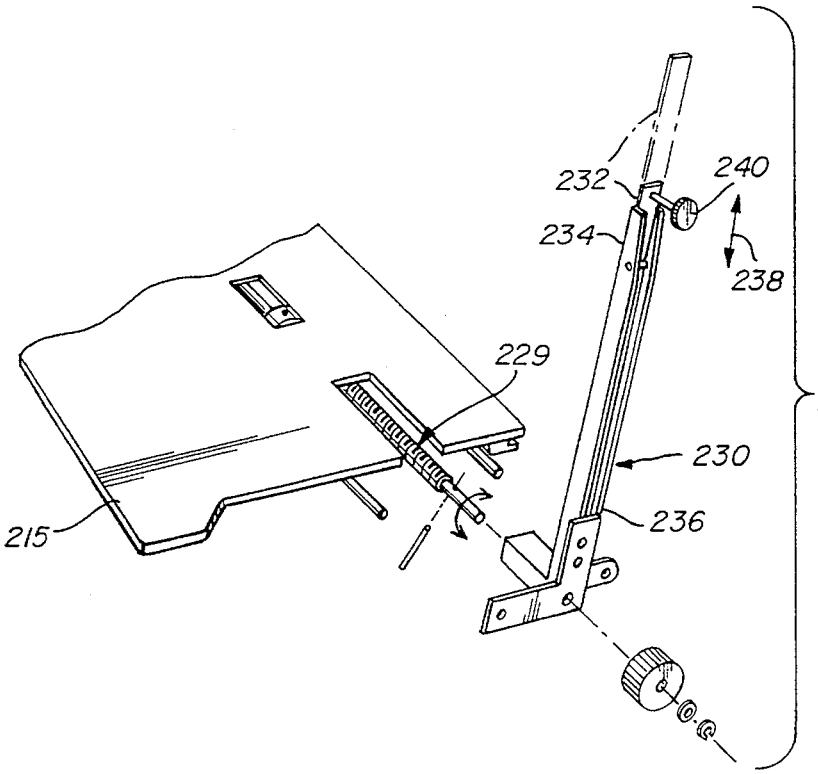
FIG. 22 is a more detailed exploded view of a modification to the drawer feed elevator platform for the printer according to this embodiment.

An additional modification that is accomplished in order to allow the feed tray 210 to enter the printer drawer 200 is the reduction in the height of the sheet stack edge guide 230 as illustrated in FIG. 22. The guide is part of a screw mechanism 229 that allows centering of sheets of various size on the platform 215. Thus, it is a desirable feature to retain should the printer 27*a* be used without the sheet feeder 21*a* at certain times. However, the unmodified guide 230 normally extends into path of the feed tray 210 as it passes through the portal 204. The normal height of the guide 230 is shown in phantom. The guide is, thus, lowered to a height that allows passage of the tray thereover. As noted, since the printer 27*a* according to this embodiment is designed to remain usable without the feeder mechanism 21*a* attached thereto, a movable extension 232 of the guide 230 is provided according to this embodiment. The extension 232 allows the guide 230 to resume its full unaltered height when needed. The extension 232 comprises an additional piece of rectangular material 234 that slides upwardly and downwardly (arrow 238) relative to the lower guide section 236. The guide extension includes a knob 240 that allows easy grasping of the extension's end for lifting and lowering of it relative to the lower guide section 236.

The front face 242 of the sheet feeder column 23*a* (FIG. 20) and the opposing lower drawer front 203 can each include intermeshing strips of hook and loop material such as Velcro®. Thus, when the feed tray 210 is passed into the drawer 200 through the portal 204, the hook and loop material 244 and 246 on each of the column face 242, or another convenient location and the drawer front 203 become intermeshed and hold the drawer 200 and column 23*a* firmly to each other. For example, in one embodiment the Velcro® is attached to an adjustable bracket located under the sheet feeder tray 210. Hence, when the sheet feeder 21*a* is pulled rearwardly on its tracks 33*a* away from the drawer 200, (generally following electronic unlocking of the drawer 200) the drawer 200 is urged to open with the sheet feeder 21*a* attached thereto, revealing the interconnection between the tray 210 and the drawer 200. Pulling the feeder 21*a* beyond a certain point, will break the adhesion between the strips of hook and loop material 244 and 246 allowing the sheet feeder 21*a* to be separated from the drawer 200.

Figure 23:
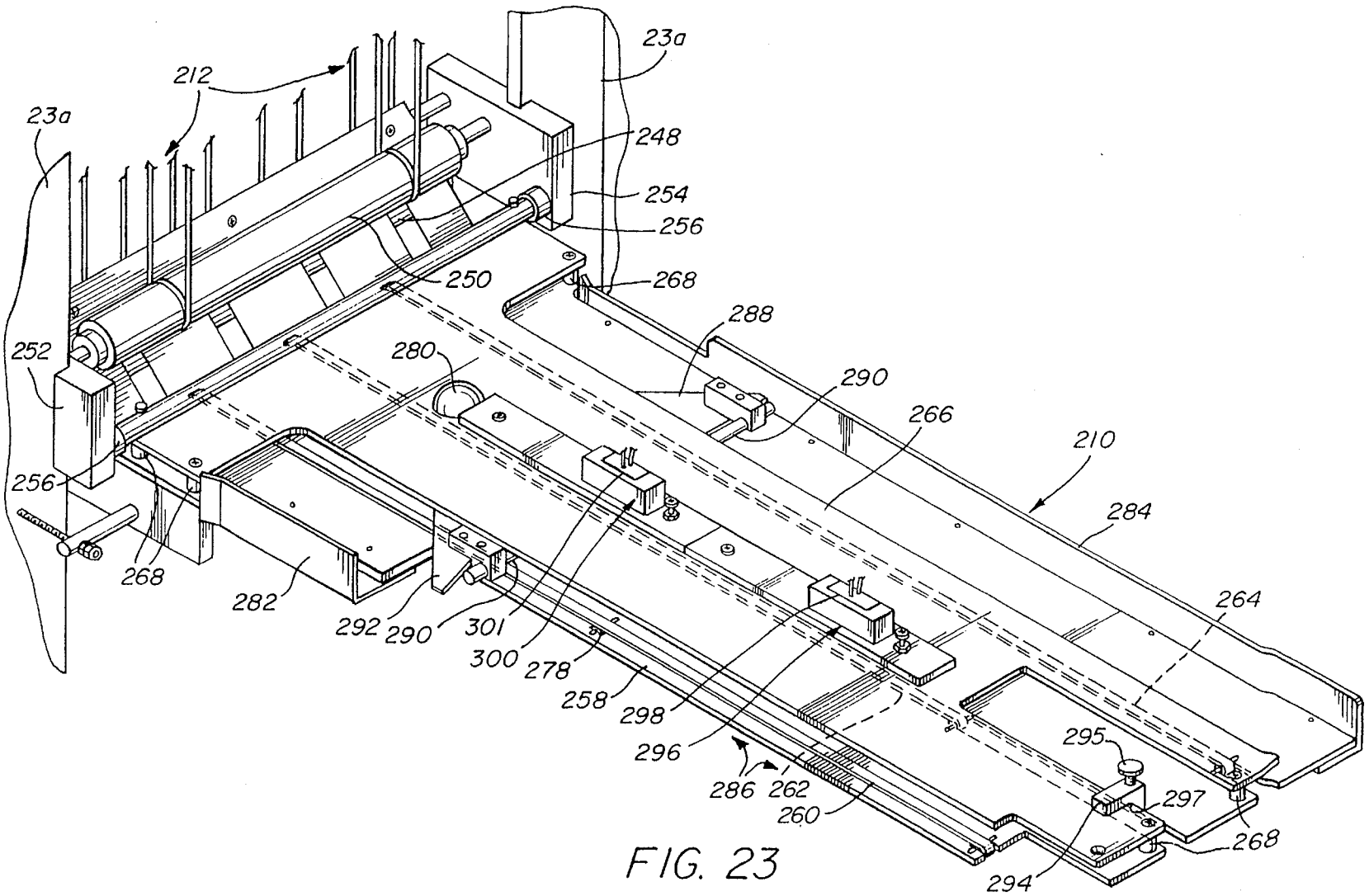
FIG. 23 is a more detailed fragmentary perspective view of the sheet feeder feed tray according to this embodiment.

Reference is now made to the sheet feeder tray 210. The tray 210 according to this embodiment is fed by means of opposing sets of substantially vertical elastomeric bridging belts 212 that direct sheets downwardly from the singulating feed mechanism 105. The singulating feed mechanism 105 is substantially similar to that described in the embodiment of FIG. 1. As further detailed in FIG. 20, the bridging belts 212 are carried by two sets of opposing rollers. The upper roller 108*a* and nip roller 107*a* are mounted in the upper portion of the column 23*a* between side panels 114*a* and 116*a*. The lower belt rollers 248 and 250 are, as shown in FIG. 23, mounted within side plates 252 and 254 that extend outwardly from the support column 23*a*. The side plates 252 and 254 include, at an outward end thereof, pivots 256 for mounting the inboard end feed tray 210. The tray 210 has a lower platform 258 with a set of three flat elastomeric belts 260, 262 and 264 positioned thereon. The belts 260, 262 and 264 rotate to drive sheets along the lower platform 258. An upper platform 266 is mounted on spacers 268 over the lower platform 258 and defines approximately a ¼–½ inch space between opposing platform faces.

Figure 23A:
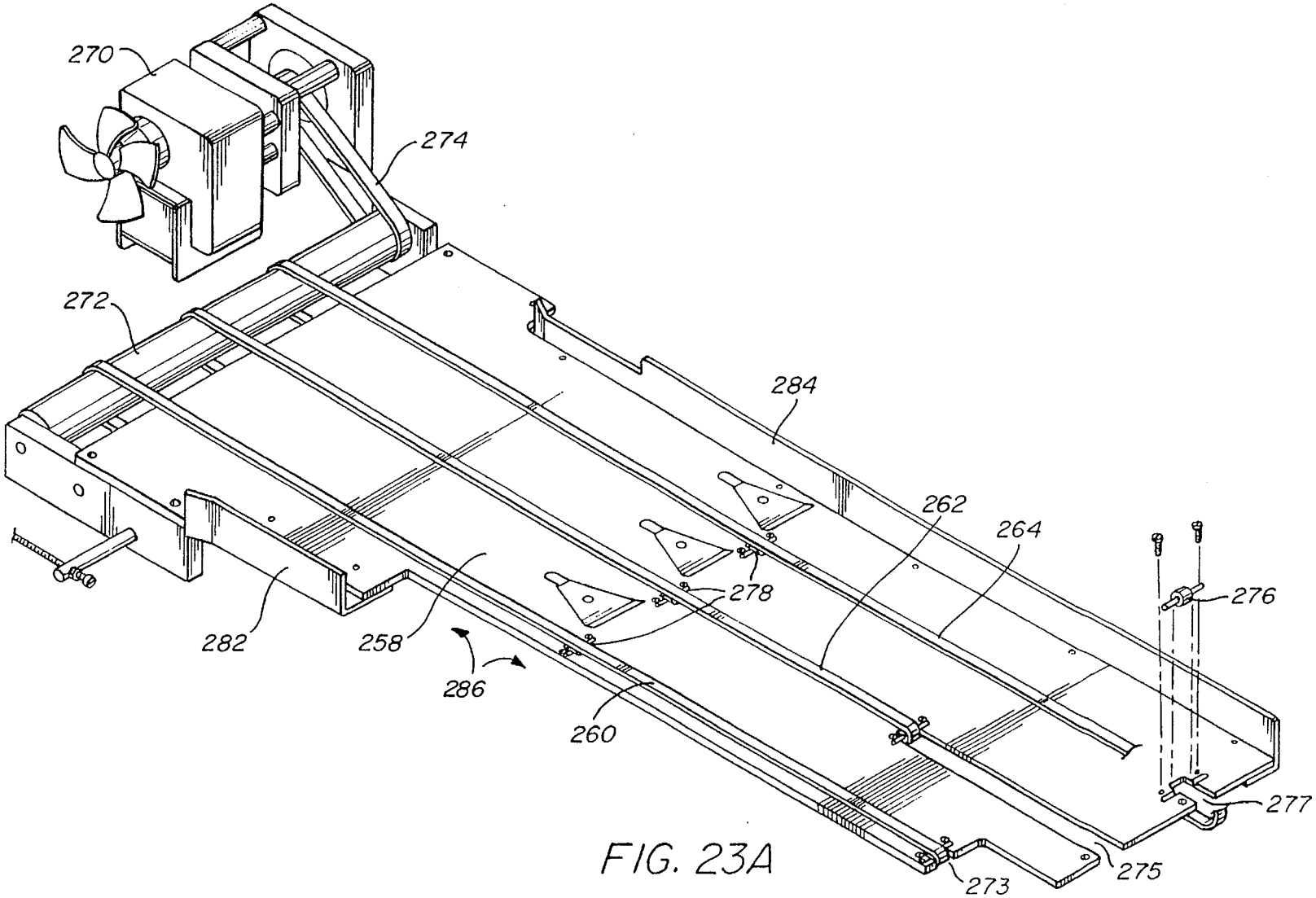
FIG. 23A is an exposed, partially exploded perspective view of the feed tray of FIG. 23.

The lower platform 258 and belts 260, 262 and 264 are more clearly illustrated in FIG. 23A which shows the upper platform 266 removed and details the interconnection between the central drive motor 270 and the belt drive roller 272. This roller 272 carries each of the belts 260, 262 and 264 on its surface. The roller 272 is driven by a timing belt 274 interconnected with the motor 270. As detailed by belt 264, the outboard ends of the belts are located in slots 273, 275 and 277 in the lower platform 258. The slots include rollers which, in this embodiment comprise needle bearings 276. The bearings have a width that is less than the width of the belts. The belts 260, 262 and 264 are urged by tension to remain centered upon their respective bearings 273, 275 and 277. A second set of supporting bearings 278 can be provided along the middle of the platform 258.

The belts 260, 262 and 264 in this embodiment comprise a polyurethane or other suitably frictional material. As sheets are driven from the bridging belts 212 on to the flat elastomeric belts of the lower platform 258, they encounter a weighted roller which, in this example, comprises a ball bearing 280 positioned within a hole in the upper platform. The ball bearing maintains the sheets against the elastomeric belts 260, 262 and 264, thus insuring that the sheets are firmly gripped by the belts as they move along the feed tray 210. The lower platform 258 includes side guides 282 and 284 along either lengthwise edge to insure that the edges of the sheets moving therealong maintain correct alignment relative to the tray 210.

As will be described further below, the side guide 282 along the right edge of the feed tray 210 has been removed proximate the distal (downstream) end of the tray. Similarly, a rectangular portion of the distal end of the right platform 258 edge has been removed, thus, creating a substantially rectangular cutout 286 in the platform 258. After the leading (downstream) edges of each of the sheets has passed under the ball bearing 280, it is then driven under a guide plate 288 and a rod-like guiding or "stacking" roller 290 that extends across the width of the tray 210. The leading edges of the sheets impinge between the stacking roller 290 and the belts 260, 262 and 264. Note that the right side 292 of the guide plate 288 is angled downwardly. The leading edge of each sheet on the sheet's right side is driven under this angled guide plate 292. The driven sheet edge is free to bend downwardly over the open cutout 286 along the distal portion of the tray since the edge is removed. The reason for forming this bend will be discussed further below.

Sheets are driven along the feed tray 210 until their leading edges contact the auxiliary stop 294 positioned at the downstream end of the tray 210 between the upper and lower platforms 266 and 258. The stop 294 includes a thumb screw 295 and a groove 297 so that it can be slid and locked into different positions along the length of the upper platform 266.

The stacking roller 290 serves to direct leading edges of sheets downwardly as they pass therethrough. Further downstream sheets which now rest against the auxiliary stop 294 are held in a substantially planar orientation with their trailing edges suspended above the bottommost edge of the roller 290. Accordingly, as new leading edges enter the downstream (distal) portion of the tray 210, these leading edges pass under the sheets that are already present on the tray 210. Hence, a stack is continuously formed by adding additional sheets to the bottom of the stack. It is contemplated that a stack size of approximately ten sheets is maintained at all times at the downstream end of the tray.

Stack size is maintained by means of a sensor 296 comprising, in this embodiment, a microswitch 298 that is activated when the thickness of the stack decreases below a predetermined number of sheets. The microswitch 298 sends an instruction to the feeder controller circuitry (not shown) instructing the sheet singulating drive 105 and vertical bridging belts 212 to transfer additional sheets to the tray 210. The sheets are transferred continuously until the microswitch 298 is deactivated, indicating presence of a sufficient number of sheets in the tray stack. A second sensor 300, upstream of the stack level sensor 296, is also provided according to this embodiment. This sensor's microswitch 301 is activated upon a decrease in stack size below a second predetermined level, indicative of a feeding jam in the sheet feeder mechanism. The sensor 300 signals a jam alarm (not shown) and can instruct the sheet feeder 21*a* to shut down operation.

Figure 24:
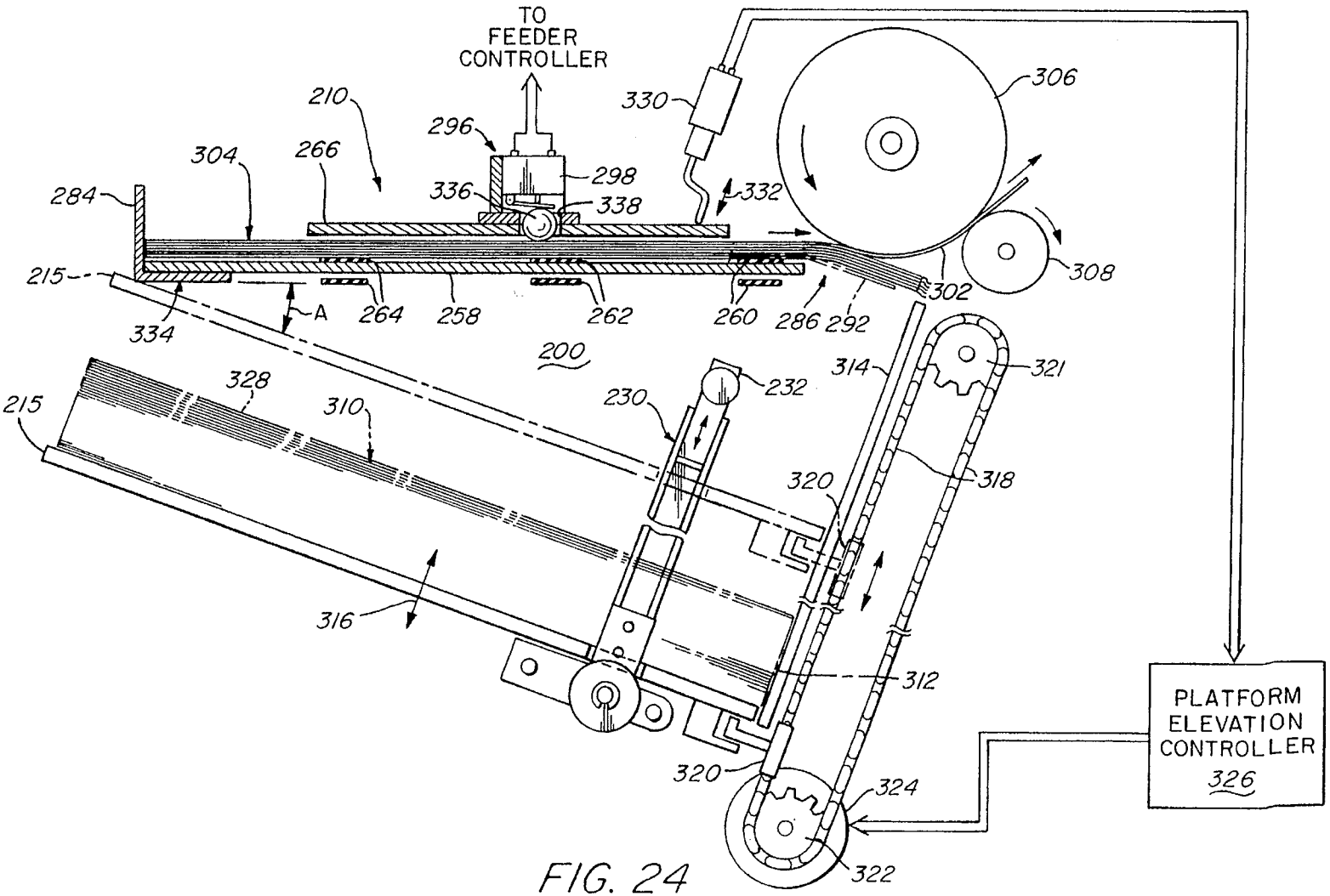
FIG. 24 is a cross-sectional front view of the printer drawer interior having the feed tray positioned therein according to this embodiment.

FIG. 24 illustrates the interfacing of the feed tray 210 with the printer mechanism. The feed tray 210 includes a plurality of sheets 302 in its stack 304 having right edges bent downwardly over the right edge cutout 286 in the lower platform 258. As noted above, the printer stack platform 215 in this embodiment is slanted at an angle A relative to the horizontal. In this embodiment, A equals approximately 20°. The tray 210 is positioned so that the sheets 302 of the stack 304 are placed into contact with a singulator drum 306 that rotates to drive sheets out of the stack and through a nip roller 308.

Figure 21A:
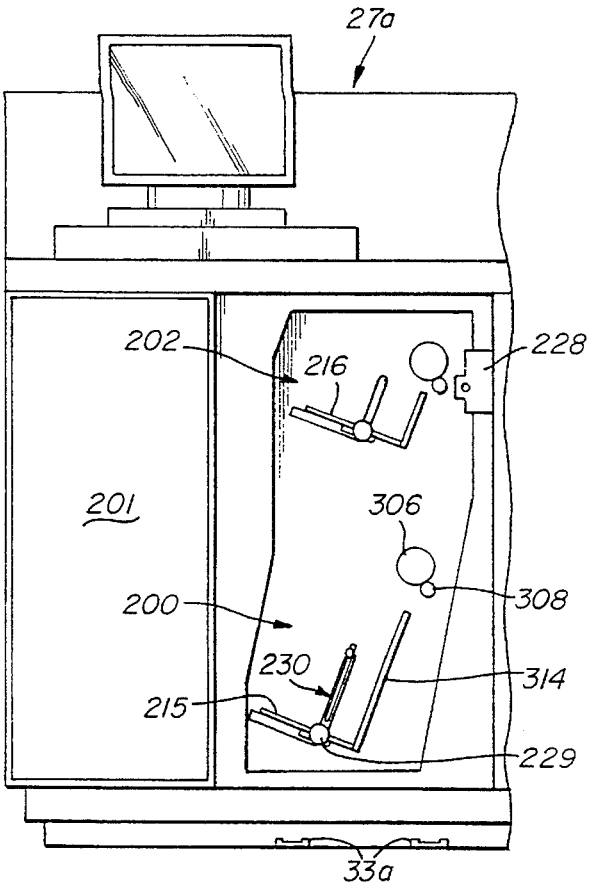
FIG. 21A is an exposed side view of the printer drawers according to this embodiment.
Figure 21B:
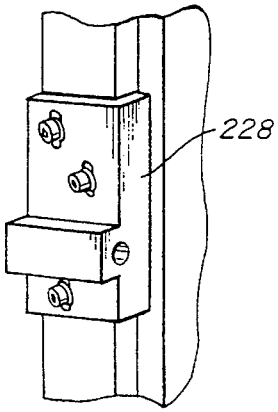
FIG. 21B is a more detailed perspective view of a feed mechanism interlock according to this embodiment.

In unmodified operation, a sheet stack 310 (shown in phantom) would be placed on the platform 215 with its right edge 312 resting against an angled wall 314 that is stationary relative to the platform 215 (see also FIGS. 21 and 21A). As discussed above, there is shown a side guide 230 with a movable upper edge 232 that is also stationary relative to the elevator platform 215 and assists in retaining the front and rear edges of the stack 310.

The elevator platform 215 is moved upwardly and downwardly (arrow 316) by means of a chain drive 318 having lifting link 320 that engages the platform 215. The chain 318 is mounted between an upper sprocket 321 and a lower motor driven sprocket 322. The motor 324 is controlled by a platform elevation controller circuit 326 that forms part of the printer's overall operating circuitry (not shown). Absent the presence of the feed tray 210, the normally loaded stack 310 would be elevated in the platform 215 by the motor 324 until the top face 328 of the stack 310 contacted a sensor switch 330. Further advance of the stack toward to the sensor switch 330 causes the switch to activate, signalling the controller 326 to stop the motor 324. Each time a sheet is driven from the stack by the singulator drum 306, the stack size decreases causing, at selected intervals, the sensor switch 330 to drop (arrow 332) signalling the platform elevator controller 326 to again raise the platform 215 until an appropriate stack height is again attained. The process continues until all sheets in the stack 310 are exhausted.

Reference is again made to operation with the sheet feeder 21*a* interfaced with the printer 27*a* according to this embodiment. The feed tray 210 according to this invention is adapted to take advantage of the above-described platform feed operating sequence in order to continuously feed sheets from the tray 210. As noted above, the tray carries a predetermined number of sheets, typically ten to fifteen, in its stack. When the sheet feeder 21*a* is wheeled on the tracks 33*a* so as to direct the tray 210 through the drawer portal 204, its elevation is slightly below the singulator drum 306. As noted, the tray pivots upwardly relative to the support column 23*a*. The pivot height is selected so that the tray 210 becomes substantially horizontal when pivoted up to the height of the singulator drum 306. The right downstream edge of the tray has been removed creating the cutout 286 so that the sheets can bend downwardly against the singulator drum 306 as illustrated. The normal feeding orientation for the sheets is approximately 20° (angle A) relative to horizontal. The cutout 286 enables the right edges of the sheets to drop downwardly under pressure of the singulator drum 306 into an angle that substantially equals 20°. Hence, the sheet edges can simulate the angled stacking normally utilized by the printer drawer 200 without the need of angling the entire feed tray 210. As a result, a more reliable feed tray can be constructed without compromising the preferred feeding orientation of the printer. Retention of the preferred feeding orientation ensures that a wide variety of sheet thicknesses and textures can be reliably fed by the printer.

It should be apparent from FIG. 20 that the downwardly angled guide plate 292 is present to ensure that the right edges of sheets entering the bottom of the stack 304 are driven under the bent right edges of sheets in the stack 304. Otherwise, the leading edges of entering sheets would strike the bent edges of the stack 304.

The singulator drum 306 according to this embodiment includes a vacuum surface that sucks the uppermost sheet against the surface. Each sheet is adhered to the singulator drum surface and driven out between the drum 306 and a nip roller 308 to an image transfer point (not shown). By providing a tray edge that allows sheets to be bent into a configuration substantially similar to those of the sheets in the normally loaded stack 310, effective singulating of sheets is enabled despite variations in surface texture and thickness. The sheets are basically placed into the same configuration as they would be if a stack 310 on the elevator platform 215 were presented to the singulator drum 306.

As noted above, the feed tray 210 is normally suspended somewhat below the singulator drum on its pivot points 256. It is pivoted upwardly into contact with the singulator drum 306 by engagement of the base 334 of the tray 210 with the left edge of the elevator platform 215. Once the drawer 200 of the printer 27*a* closes, its circuitry is automatically triggered to raise the platform 215 until the stack level sensor 330 signals the platform elevator controller 326 to stop the elevator motor 324. Hence, upon closing of the drawer 200, the platform 215 rises until it begins to raise the tray 210 upwardly toward the singulator drum 306. The upper platform 266 of the tray 210 then contacts the sensor 330. The sensor 330 "thinks" that the face of the normally loaded stack (310) has reached its desired upward level of travel. The platform elevator motor 324 is, thus, signaled to stop. At this time, the platform 215 is positioned as shown in phantom. The platform will remain in its raised position as long as the tray 210 is located in the drawer. To remove the tray 210 from the drawer 200, it is necessary to instruct the printer 27*a* (usually via its control panel 331 shown in FIG. 19) to lower the platform 215. This usually takes the form of an "ADD PAPER" command that lowers the platform 215 and allows the drawer to be unlocked.

FIG. 24 also more clearly details the tray feed supply sensor 296 and similarly constructed jam sensor 300. The sensor 296 comprises a microswitch 298 mounted above a small ball bearing 336. The ball bearing 336 rides within a hole 338 in the upper platform 266 and can move in all degrees of freedom, thus facilitating both linear and side-to-side motion of sheets in the tray 210. As sheets 302 are driven out of the stack 304 to the side by the singulator drum 306, the tray stack 304 decreases in thickness. The ball 336, thus, lowers causing the microswitch 298 to activate. In response to the switch 298, more sheets are added to the bottom of the stack 304, increasing its thickness and raising the ball 336. When the stack reaches a predetermined thickness, the switch 298 is again deactivated signalling the sheet feeder mechanism to cease feeding sheets to the tray 210.

Figure 25:
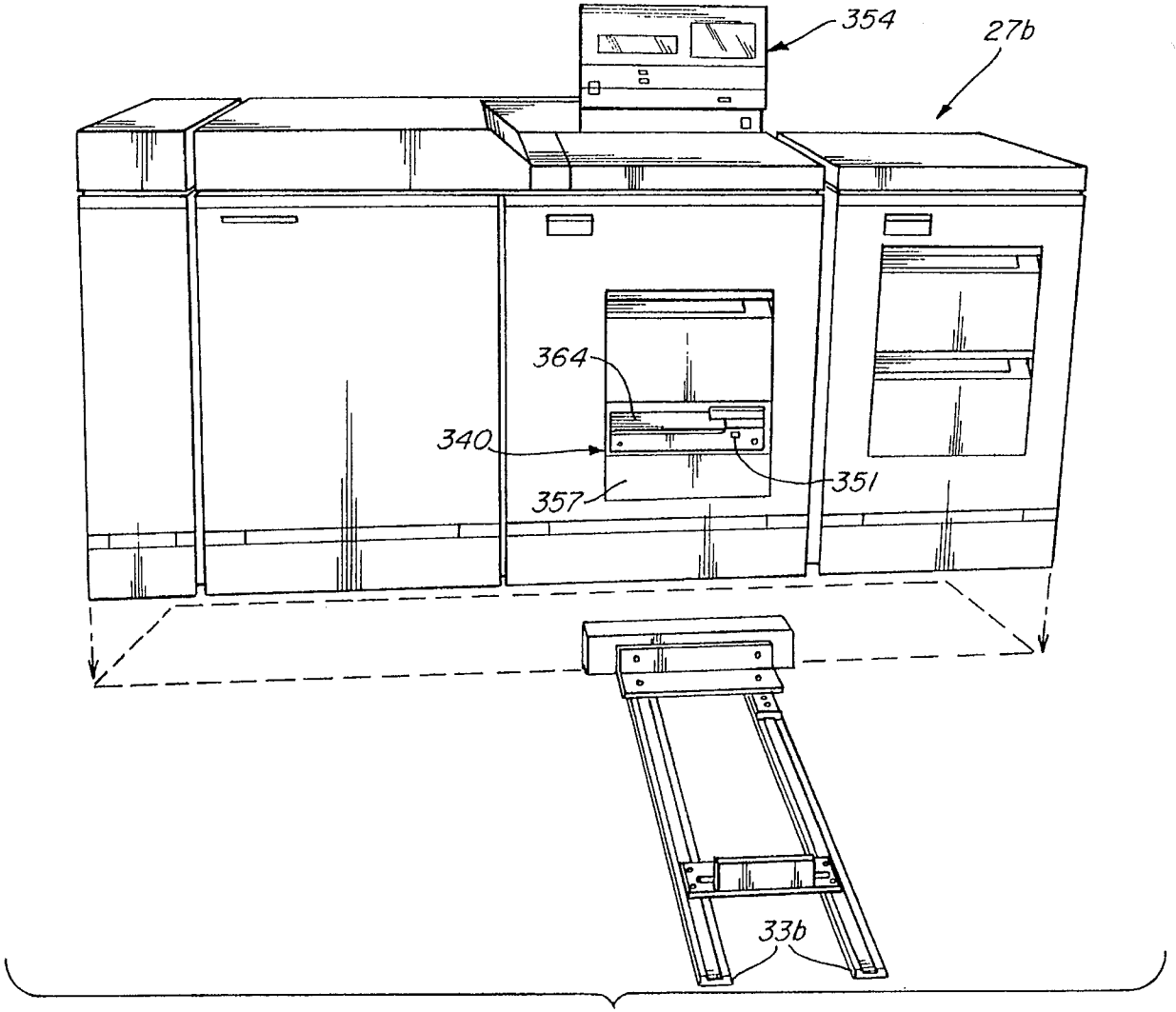
FIG. 25 is an exploded perspective view of a modification to a drawer loaded printer according to yet another alternative embodiment of this invention.

The above-described sheet feeder embodiment is particularly suited to printer units having stack feed elevator platforms tilted on an angle and positioned in movable drawers. The singulators of such units are typically fixed within the interior of the machine and do not move relative to the drawer. The sheet feeder mechanism according to this invention can also be adapted to interface with self-contained singulator and stack feed elevator platform drawer assemblies such as those utilized in the Xerox® model 4090 printer. The adaptation of a printer **27*b* having such a self-contained drawer unit 340 is depicted in FIG. 25. A set of tracks 33*b* is located to access the lower drawer unit 340 of this printer 27*b***.

Figure 26:
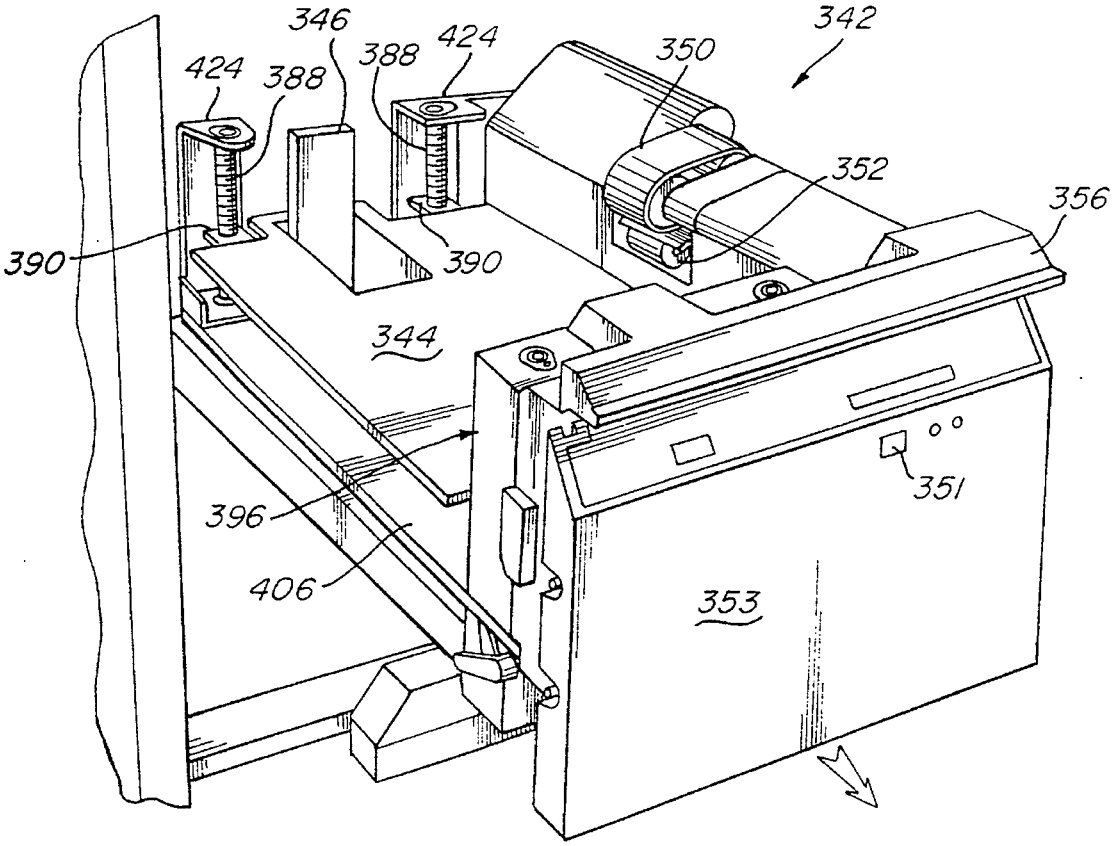
FIG. 26 is a perspective view of an unmodified feed drawer for the printer according to this embodiment.

An unmodified lower drawer 342 is shown in FIG. 26 for illustration of the drawer's operation and required modifications for interface with a sheet feeder according to this invention. Note that the drawer 342 comprises an elevator platform 344 having a movable rear edge guide 346 and a set of four lead screws 388 that move the platform 344 upwardly and downwardly upon demand. The sheets of a stack (not shown) positioned on the platform 344 are driven to an image transfer point (not shown) by means of a singulator belt 350 and lower nip roller 352. The singulator belt 350 according to this embodiment pivots upwardly and downwardly and includes an internal sensor that detects upward pivoting of the belt 350. In operation, the elevator platform 344 is directed to rise by the printer's control circuitry until the stack face pivots the singulator belt 350 to a predetermined upward point, thus indicating that the stack is completely in contact with the belt 350. As sheets are removed from the stack, the belt 350 drops on its pivot causing the elevator platform 344 to again rise so as to maintain the face of the stack in constant contact with the belt 350.

Printers such as the Xerox® model 4090, 4135 and other related models include a double interlock system in which the user must activate a tray unlock control 351 on the front 353 of the drawer 342 (FIG. 26) and/or on the control console 354 (FIG. 25) and then wait until the platform 344 has lowered. The user can then open the drawer by pulling up on the hand operated drawer latch handle 356.

Figure 27:
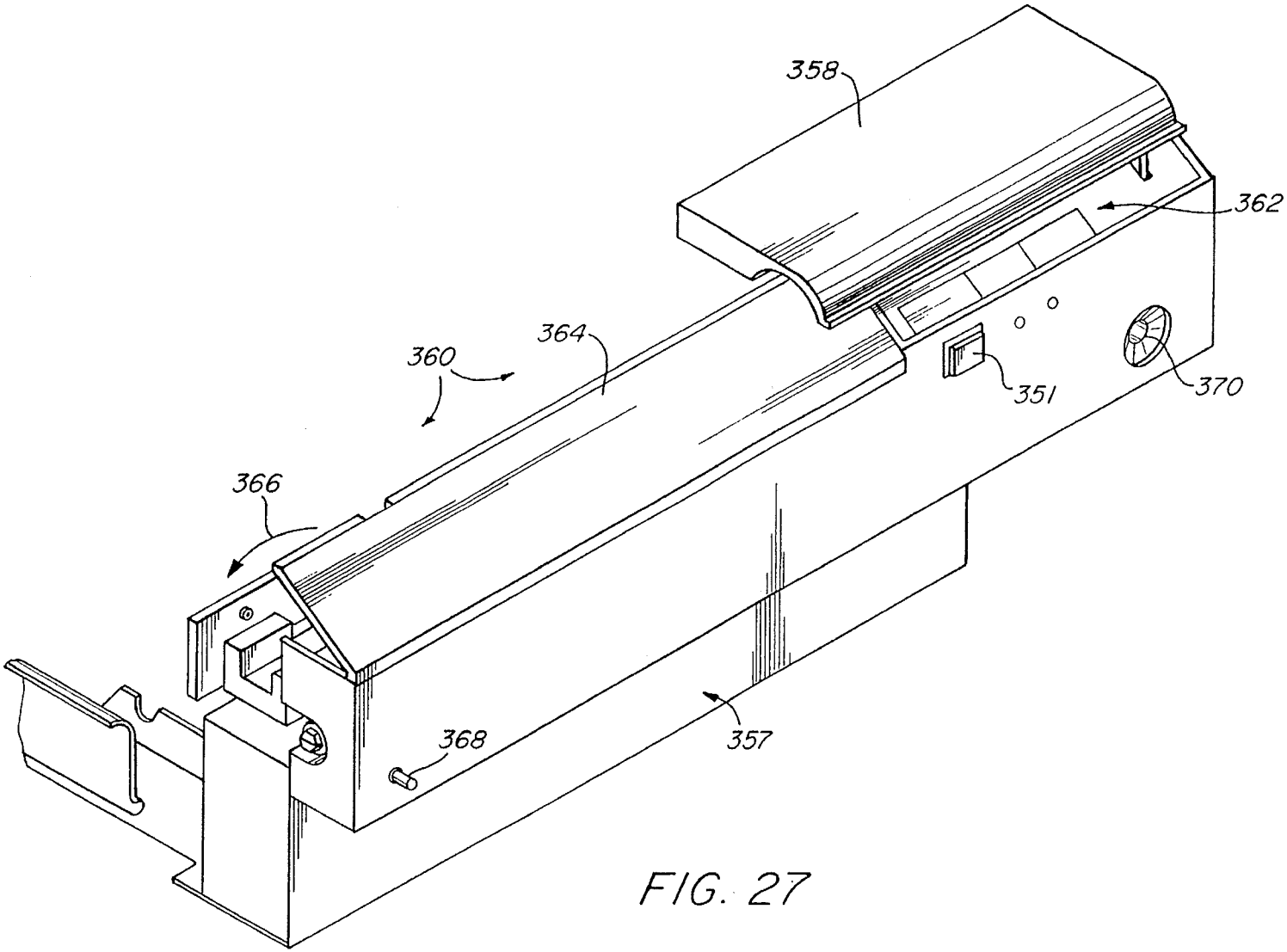
FIG. 27 is a fragmentary perspective view of a modified feed drawer for interfacing with the sheet feeder according to this embodiment.

FIG. 27 details a modification to the drawer front 357 of printer **27*b* in order to allow a feed tray to enter therethrough. The door latch 358 has been shortened so as to create a widthwise channel 360 on the left hand portion of the drawer front 357. The angled panel 362 located below the drawer latch handle 358 has been modified to include a pivoting door 364 that can pivot into a flat position as shown by the arrow 366. The door 364 can be released to pivot downwardly by means of the latch button 368 positioned on the left hand face of the drawer front 357. The drawer front 357 has been further modified to include an orifice 370 on the right hand side thereof. The orifice 370 allows entry of an interlock probe on the support column 23*b* of the feeder 21*a* which will be described further below. The drawer interlock disables the drawer latch handle 358 since it is not normally accessible when the printer 27*b* is interfaced with the sheet feeder 21*b*. The orifice 370 also serves to align the sheet feeder 21*b* with the drawer 342**.

Figure 28:
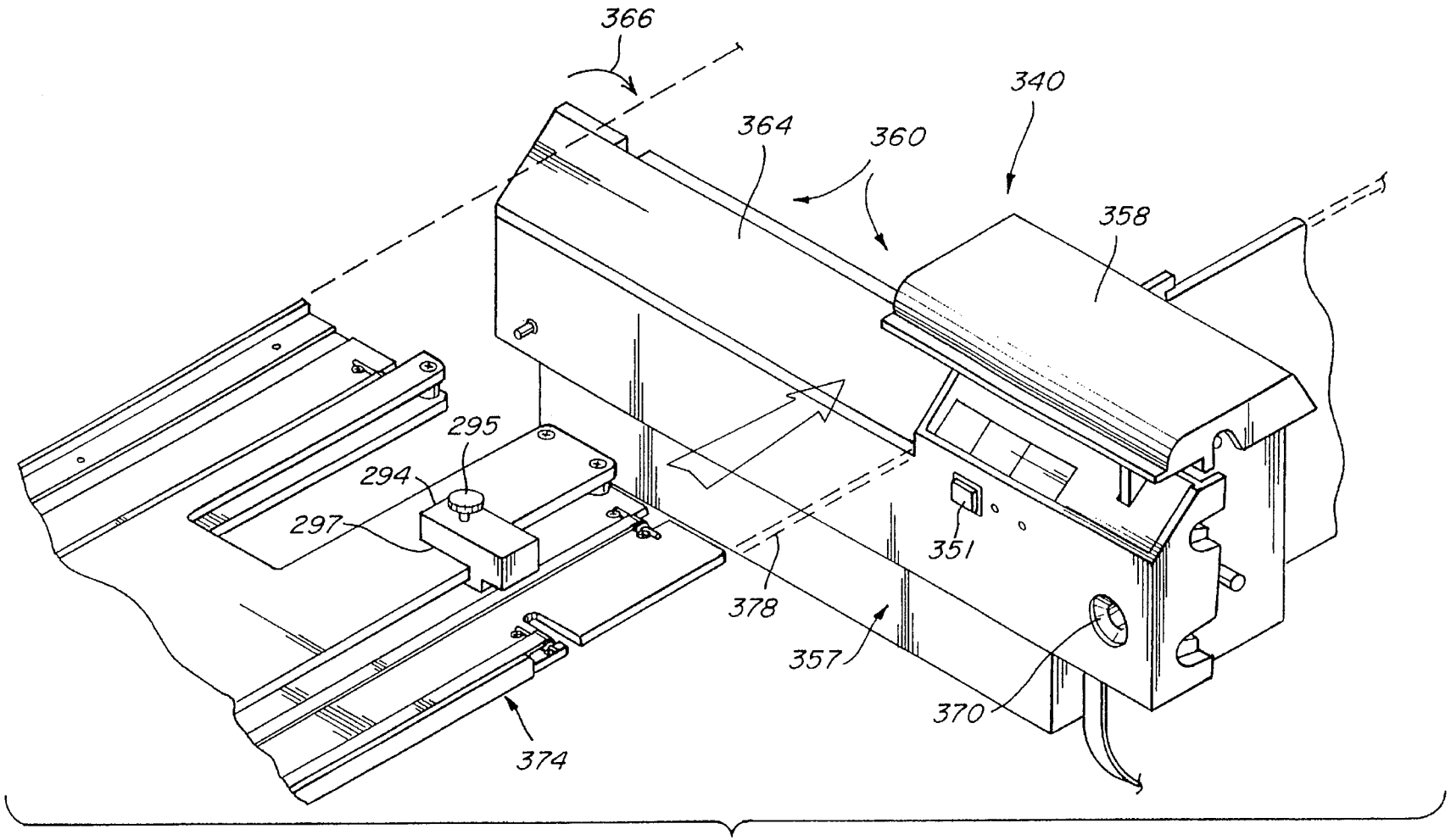
FIG. 28 is a fragmentary perspective view of the feed drawer and feed tray according to this embodiment detailing the interfacing entry path for the tray into the drawer.
Figure 29:
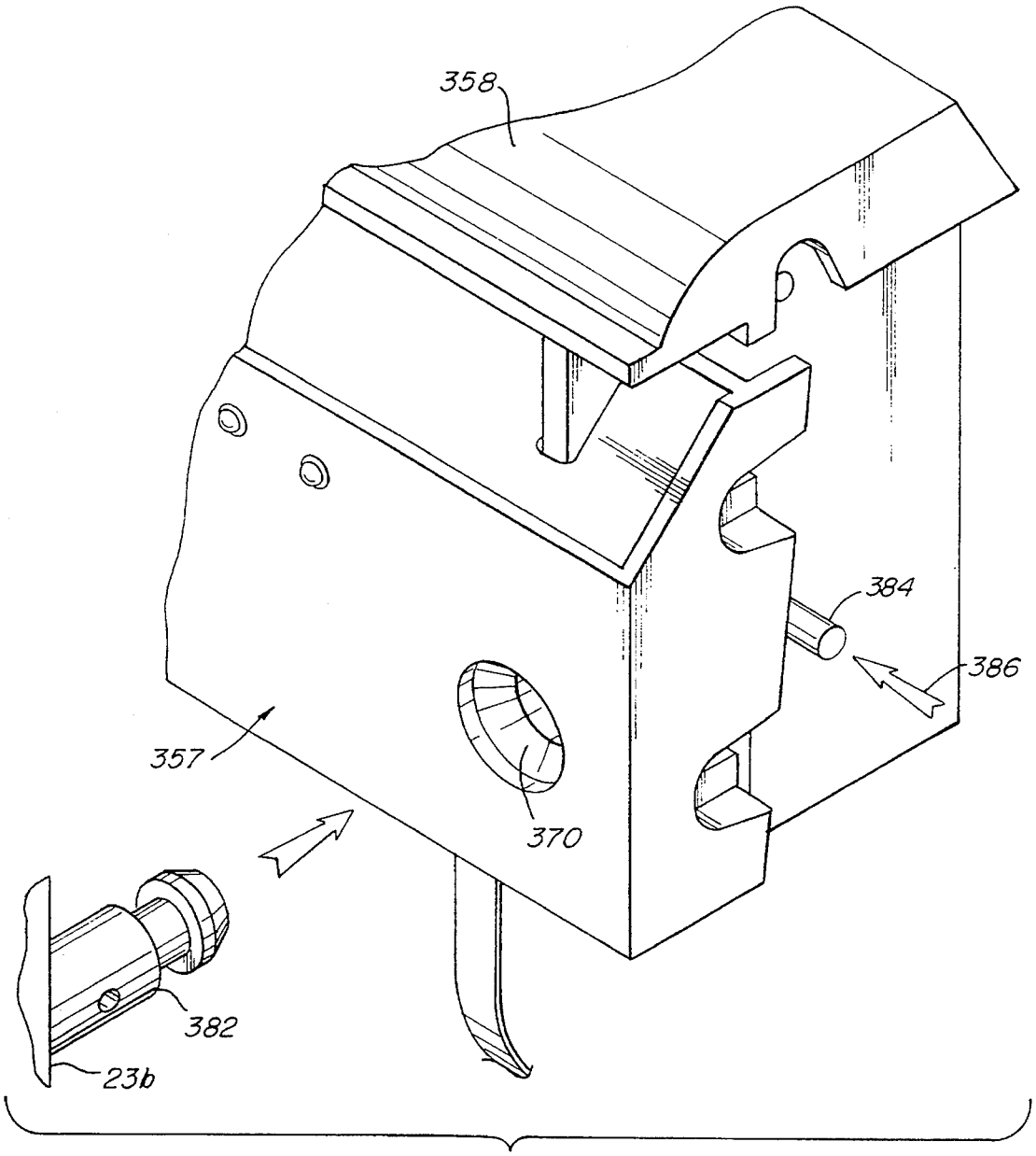
FIG. 29 is a fragmentary perspective view of the modified feed drawer according to this embodiment detailing the sheet feeder interlock.

As depicted in FIG. 28, the door 364 on the drawer 342 is pivoted downwardly as shown by the arrow 366 and the feed tray 374 of this embodiment is inserted through the resulting port or channel 360 along the dashed line 378 as shown. As the tray 374 is fully inserted, the support column **23*b* approaches a face-to-face engagement with the drawer front 357. As depicted in FIG. 29, the interlock probe 382 on the support column 23*b* engages the orifice 370 causing the drawer locking pin 384 to retract as shown by the arrow 386. The drawer latch handle 358 is, hence, disabled and only the interval electronic (control activated) locking mechanism remains to lock and unlock the drawer 340**.

Figure 30:
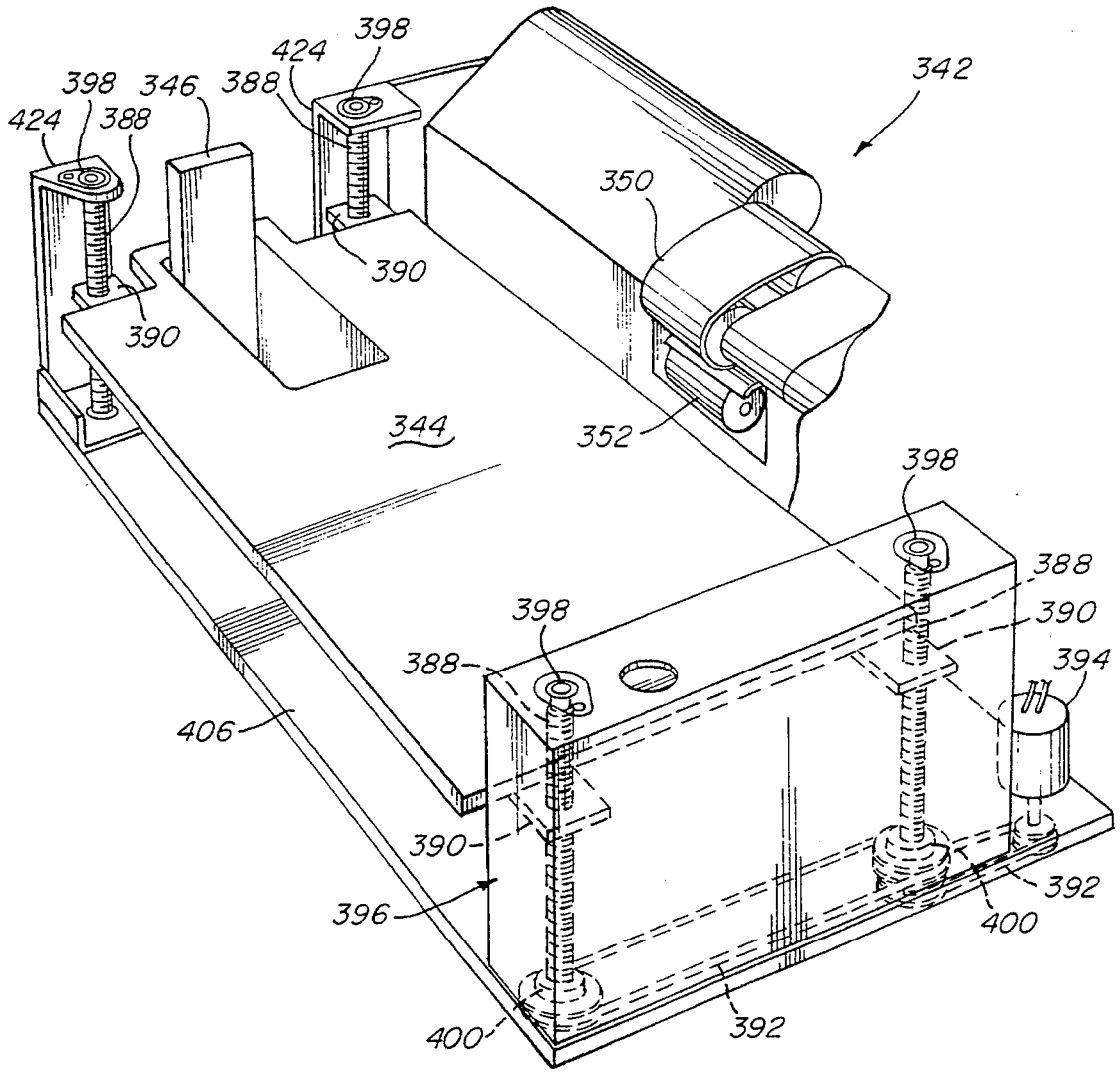
FIG. 30 is an exposed perspective view of an unmodified drawer feed elevator platform mechanism according to this embodiment.

With reference to FIGS. 26 and 30, the stack elevator platform 344 of this embodiment is supported at four threaded corner brackets 390 on four revolving lead screws 388. The lead screws 388 are each driven at their bases by belts 392 interconnected with a drive motor 394. The screws each turn at an equal rate to raise and lower the platform evenly. The front end of the platform proximate the door includes a housing 396 for mounting the front set of lead screws 388. A set of upper and lower bearings 398 and 400 are positioned on each end of the housing 396. As the screws 388 turn, the corner brackets 390 ride upwardly or downwardly upon them depending upon the direction of screw rotation.

Figure 31:
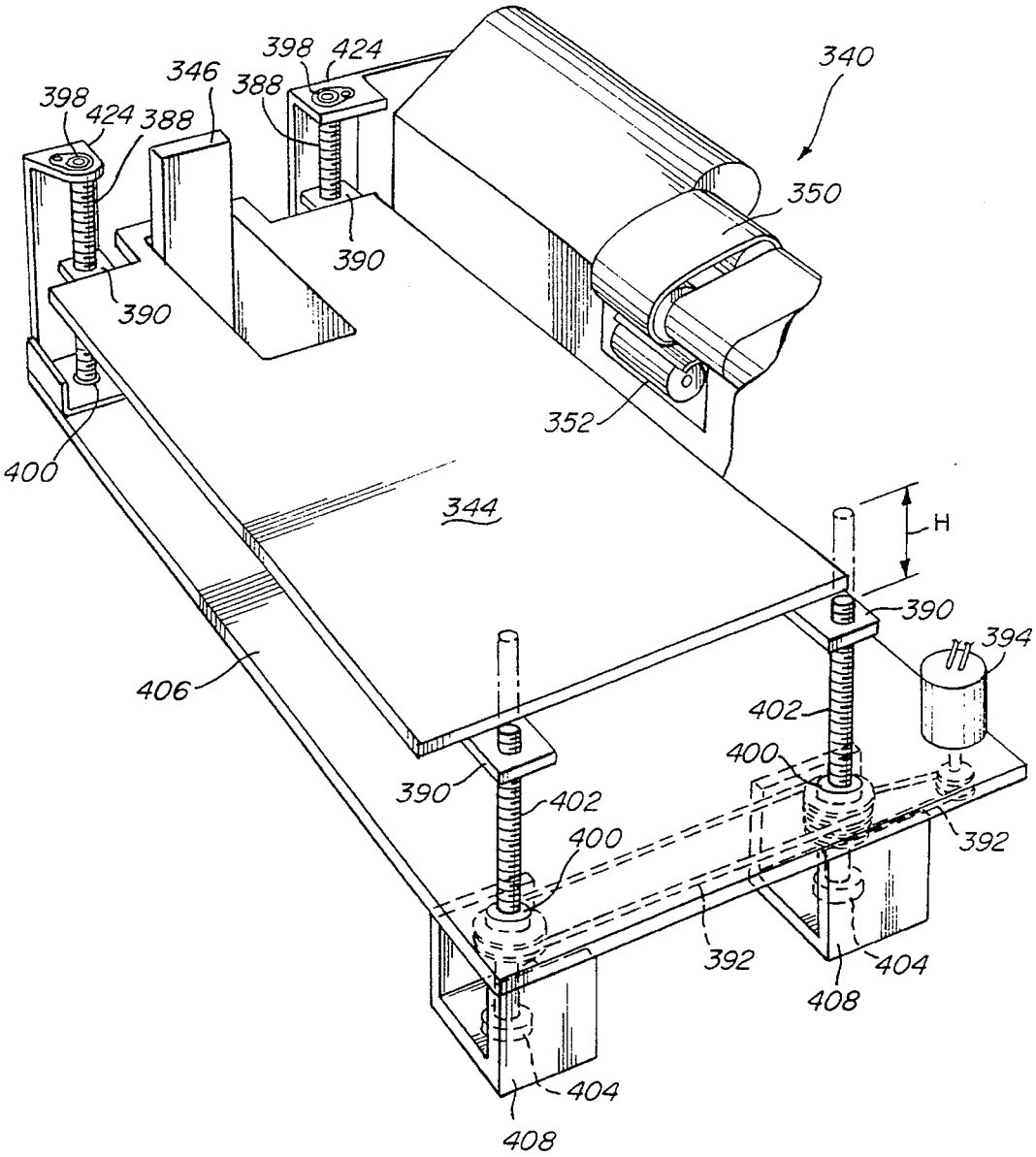
FIG. 31 is an exposed perspective view of a drawer feed platform of a modified feed drawer elevator platform adapted to receive the feed tray according to this embodiment.

As shown in FIG. 26, the housing 396 is essentially the same height as the unmodified drawer front 353. As such, the housing 396 effectively blocks the entry of the feed tray thereinto. The drawer 340 is therefore modified according to this embodiment to remove at least the top portion of the housing 396. As depicted in FIG. 31, the modified front set of screws 402 are shortened by a distance H without interfering with the full upward extension of the platform 344. However, when removing the housing 396, the front screws 402 must be stabilized so that they do not sway since the upper bearings 398 are removed with the top portion of the housing. Stabilization is accomplished by providing a cantilevered bearing 404 below the level of the drawer base 406 to each screw 402. The cantilevered bearing 404 on each screw 402 provides additional support. A bracket 408 for each cantilevered bearing 404 is provided and should be spaced sufficiently from the base 406 to prevent swaying of the uppermost portion of each front screw 402. As depicted, each screw 402 must be extended downwardly sufficiently to meet the cantilevered bearing 404.

Figure 32:
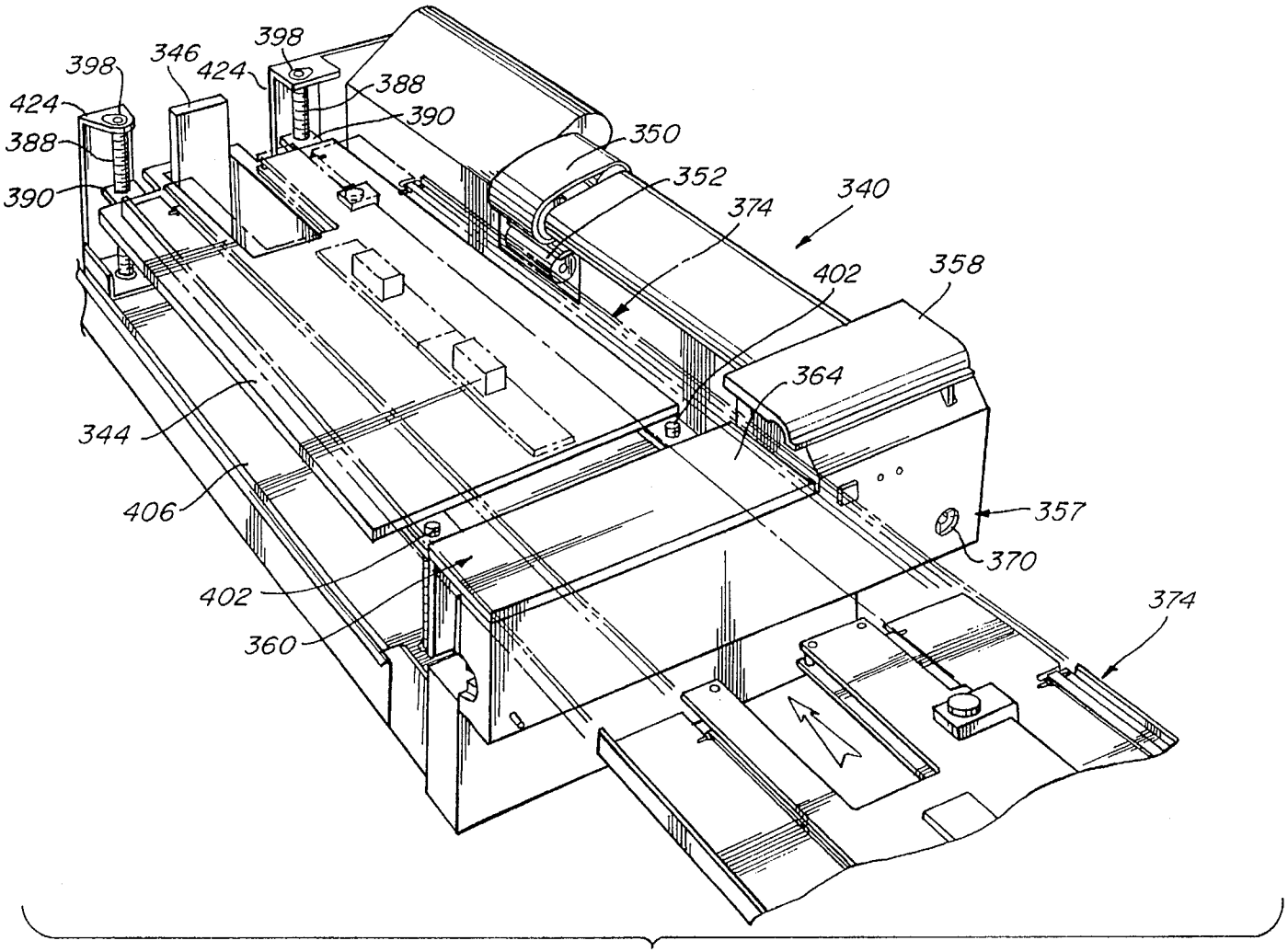
FIG. 32 is an exposed perspective side view of the modified drawer feed elevator platform detailing the path of entry of the feed tray thereinto according to this embodiment.

As depicted in FIG. 32, the lowered profile of the front screws 402 enables the feed tray 374 to be slid into the modified drawer 340 as shown in phantom. The platform 344 can then raise the tray 374 into contact with the drawer's singulator belt 350.

Figure 33:
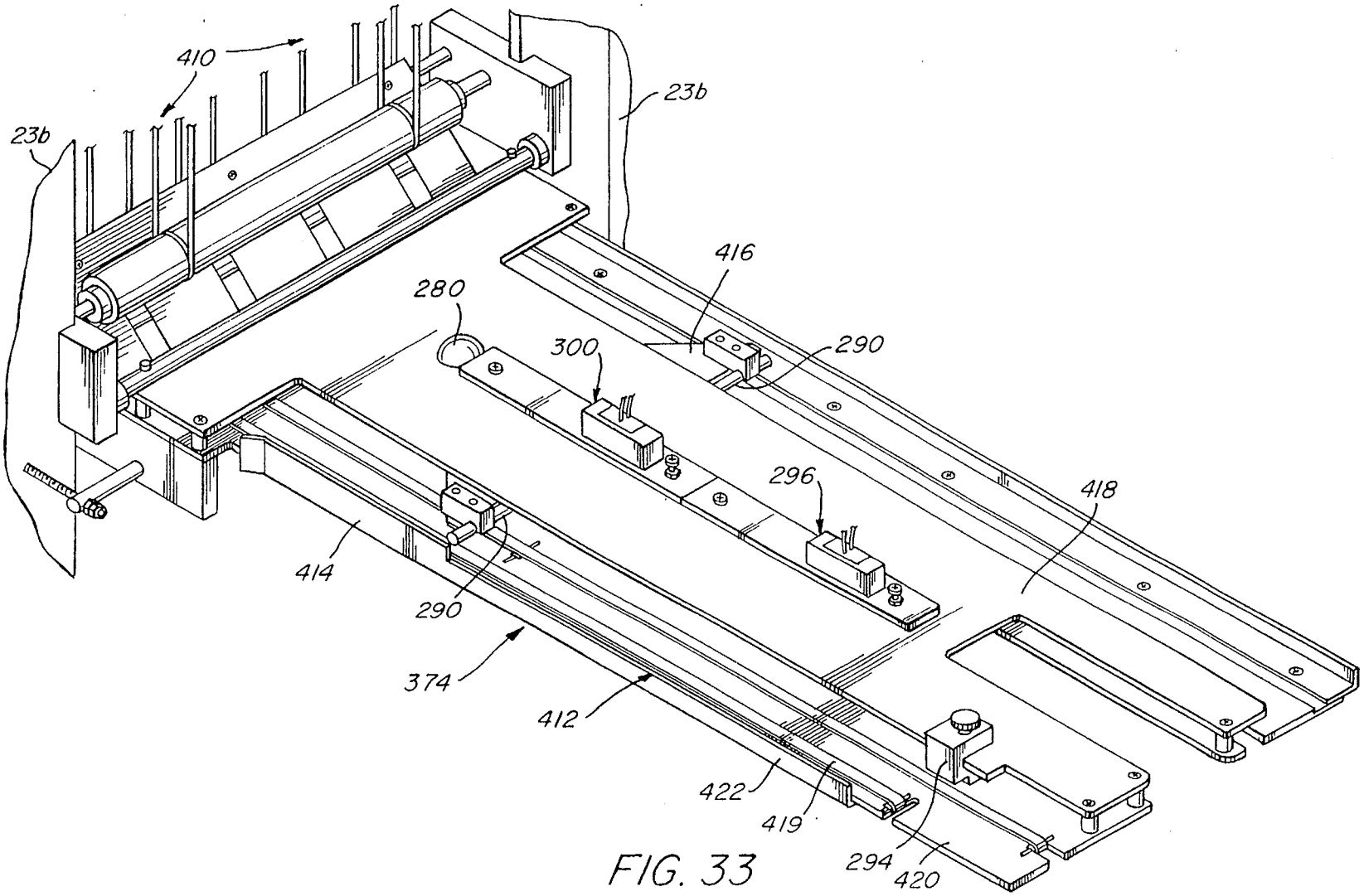
FIG. 33 is a more detailed fragmentary perspective view of the feed tray according to this embodiment.

FIG. 33 further details the feed tray 374 according to this embodiment. The vertical bridging belts 410 guide sheets to the feed tray 374 in a manner similar to those described for the preceding embodiment. The tray 374 is also configured substantially similarly to that shown in FIG. 23 for the previously described embodiment. This tray 374 generally differs in its exact elevational location on the support column **23*b* in order to interface with a different printer drawer than that of FIG. 23. This tray 374 also differs in that it includes a full width uncut edge 412 along its right side and an edge guide 414 that extends substantially the full length along the right side. There is also an unbent guiding plate 416 positioned between the upper and lower platforms 418 and 420. The stacking roller 290 is substantially similar to that of the preceding embodiment. Note that the edge guide 414 has a lowered profile section 422 downstream of the stacking roller 290. The tray sheet stack is positioned proximate this section 422 of the edge. Thus, the edge guide 414 is lowered at this point so that the uppermost sheets of the stack can pass out of the stack to the right as they are driven by the drawer's singulator belt 350. The tray 374 includes feed and jam sensors 296 and 300 as well as a similar adjustable auxiliary stop 294 according to this embodiment. A ball bearing 280 mounted in the upper platform 418 is also provided upstream of the guiding plate 416 and stacking roller 290**.

Additionally, as illustrated in FIG. 33, the feed tray 374 of this embodiment includes an additional elastomeric drive belt 419 along the right edge of the lower platform 420. This belt is provided to insure adequate transfer of sheets to the end of the tray. In the preceding embodiment, this area was occupied by a cutout 286.

Figure 34:
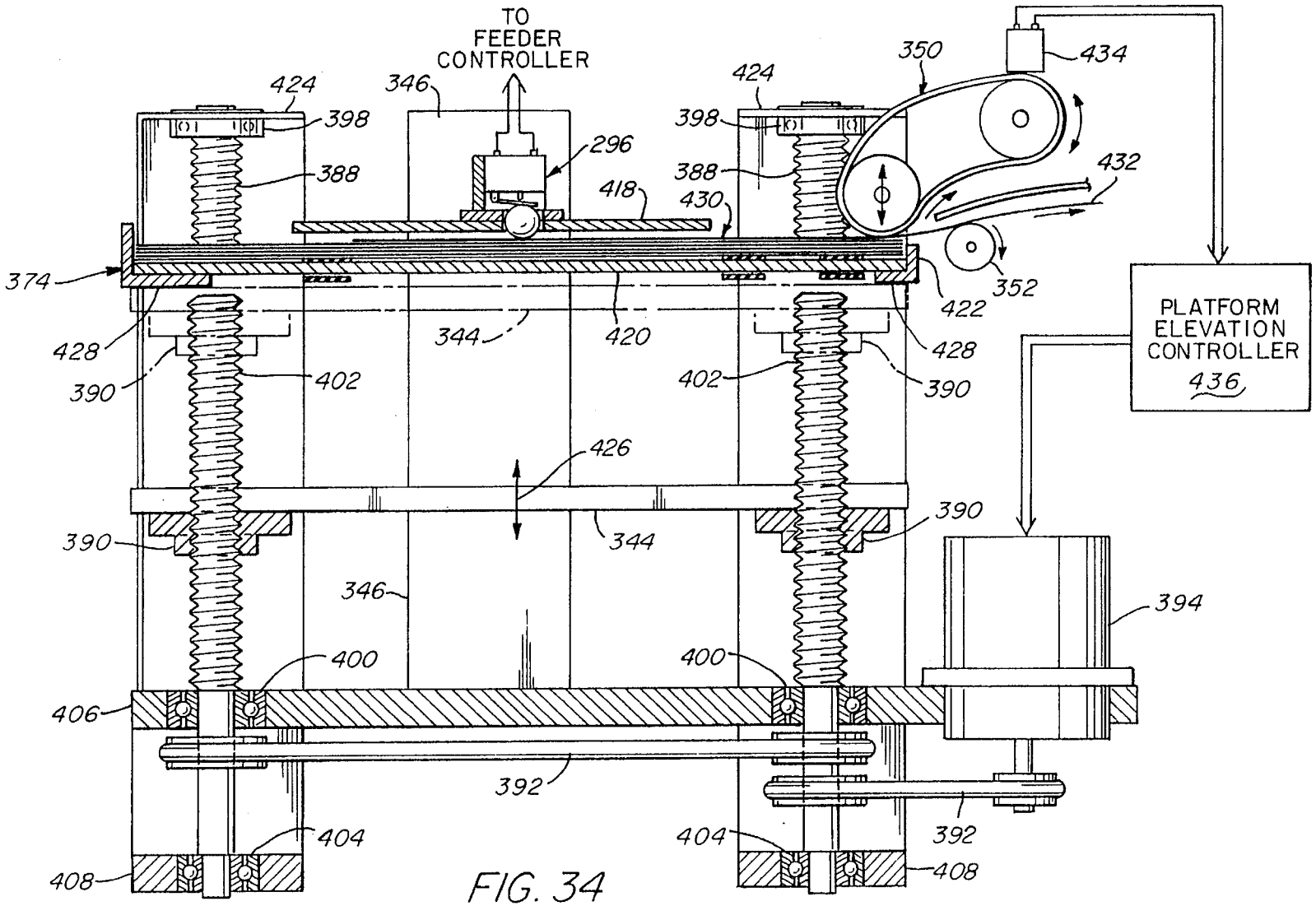
FIG. 34 is a cross-sectional front view of the modified drawer feed platform according to this invention having the feed tray positioned therein.

FIG. 34 illustrates a cross-sectional front view of the feed tray 374 interfaced with the drawer 340. Note that the front lead screws 402 are lowered to a position below the tray in comparison to the normal height rear lead screws 388. The rear lead screws 388 still include their associated bearing housings 424. Note also the presence of the cantilever bearing brackets 408 and bearings 404 for the front lead screws 402. The platform 344 can be raised and lowered by the screws 388 and 402 as shown by the arrow 426. In an uppermost position (shown in phantom) the platform 344 bears upon the lower surface 428 of the feed tray 374 causing the supported stack 430 of sheets 432 to contact and raise the singulator belt 350 upwardly. The upward movement of the singulator belt 350 is detected by the belt's internal sensor 434 (shown schematically) which can comprise an optical sensor according to this embodiment. The sensor 434 instructs the lead screw drive motor 394 to stop when a sufficient stack height has been reached. Again, as in the preceding embodiment, the tray elevation controller 436 is "tricked" into thinking that the front face of a normally supported stack has been presented to the singulator belt 350. In reality, the much smaller continuously replenished stack 430 of the feed tray 374 is presented to the singulator belt 350.

As sheets 432 are driven rightwardly out of the tray stack 430, the feed sensor 296 of the tray 374 directs the feeder singulating mechanism and bridging belts to deliver additional sheets to the underside of the tray stack 430. As such, a constant predetermined stack thickness is maintained. Note that in both of the preceding examples, by delivering sheets to the underside of the stack, these newly added sheets do not interfere with the operation of the printer singulator. Similarly, the printer singulator does not interfere with the entry of these newly added sheets into the tray stack. The tray feed sensor 296 is more sensitive than the singulator belt sensor 434. As such, sheets are replenished to the tray 374 by operation of the feed sensor 296 long before the singulator belt 350 drops far enough to signal a rise in the stack elevator platform 344.

It will thus be seen that the objects set forth above, and those made apparent from the preceding description, are efficiently attained and, since certain changes may be made in the above construction without departing from the scope of the invention, it is intended that all matter contained in the above description or shown in the accompanying drawings shall be taken by way of example and shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A high speed sheet feeder for directing sheets to a host utilization device having a stack feed elevator platform accessed by a drawer, the sheet feeder comprising:

a feed ramp for supporting a stack of sheets;

a feeder singulator for deshingling sheets from the stack;

a feed tray remote from the feeder singulator for receiving sheets from the feeder singulator, the tray including a space for locating sheets therein and the tray further including an opening proximate the space for locating sheets therein so that sheets can be slid from the space; and the feed tray being constructed and arranged to pass through a port in the drawer of the utilization device so that sheets in the space ate positioned proximate a utilization device singulator that is located adjacent the drawer and the tray including a bracket that enables the feed tray to be moved by the stack feed elevator platform, in the manner of a stack supported by the platform, so that sheets in the space are brought into engagement with the utilization device singulator.

2. A high speed sheet feeder as set forth in claim 1 further comprising a pivot positioned on the tray so that the tray is raised and lowered by a stack feed elevator platform in the printer to bring the second stack of sheets, respectively, into and out of contact with the utilization device singulator.

3. A high speed sheet feeder as set forth in claim 2 further comprising a plurality of substantially vertical bridging belts for directing sheets from the feeder singulator to the tray.

4. A high speed sheet feeder as set forth in claim 3 wherein the tray comprises a lower platform and an upper platform, the stack opening being defined in a space therebetween and the lower platform including a plurality of conveyor belts for transporting sheets along the tray to the second stack.

5. A high speed sheet feeder as set forth in claim 4 wherein the tray further comprises a stacking guide that directs sheets fed by the conveyor belts to a position in the stack between a bottom face of the stack and the lower platform.

6. A high speed sheet feeder as set forth in claim 1 wherein the tray includes a slot along a side thereof for allowing sheets to be slid from the top of the second stack by the utilization device singulator in a direction substantially transverse to a direction in which sheets pass from the feeder singulator to the tray.

7. A high speed sheet feeder as set forth in claim 6 wherein the tray includes a recessed edge proximate the slot for allowing overhanging sheet edges to be bent downwardly in contact with the utilization device singulator.

8. A high speed sheet feeder as set forth in claim 1 wherein the drawer includes a front having a selectably releasable door therein for receiving the tray.

9. A high sheet feeder as set forth in claim 8 wherein the feed ramp includes an interlock probe and wherein the drawer includes an interengaging orifice for receiving the probe, the interlock disconnecting a drawer lock for enabling the drawer to be opened and closed in conjunction with the tray interconnected thereto.

10. A high speed sheet feeder as set forth in claim 8 wherein the drawer includes a stack feed elevator platform having a plurality of feed screws thereon for raising and lowering the platform, a pair of feed screws proximate the drawer front being lowered to allow positioning of the tray thereover, lower ends of the screws being supported by lowermost bearings on brackets extending below a base of the drawer.

11. A high speed sheet feeder as set forth in claim 1 further comprising a feed sensor for detecting a thickness of the second stack, the feed sensor being interconnected to the feeder singulator so that a thickness below a predetermined level signals the feeder singulator to direct additional sheets to the second stack.

12. A high speed sheet feeder as set forth in claim 11 wherein the feed sensor comprises a ball bearing engaging the stack and a microswitch positioned over the ball bearing so that vertical movement of the ball bearing alternatively activates and deactivates the microswitch.

13. A high speed sheet feeder as set forth in claim 12 further comprising a jam sensor positioned on the tray upstream of the feeder sensor, the jam sensor detecting a second stack thickness below a second predetermined level, the jam sensor signalling a jam alarm in response thereto.

14. A high speed sheet feeder as set forth in claim 1 wherein the utilization device includes at least two drawers, the drawers being positioned with one of the drawers atop another of the drawers and wherein the feed tray is constructed and arranged to be positioned through the portal in one of the drawers so that another of the drawers can be accessed for loading with sheets.

15. A high speed sheet feeder as set forth in claim 14 wherein the portal is positioned on a lower of the at least two drawers.

16. A high speed sheet feeder for directing sheets to a host utilization device having a stack feed elevator platform accessed by a drawer, a utilization device singulator for driving sheets from a stack of sheets located on the stack feed elevator platform and a stack level sensor constructed and arranged to at least one of (1) move the stack feed elevator platform to locate a top sheet of the stack adjacent the utilization device singulator and (2) indicate a fault, in response to a sensed level of a top sheet in the stack relative to the utilization device singulator, the sheet feeder comprising:

a feed structure for supporting a stack of sheets;

a base structure for supporting the feed structure relative to a floor surface;

a feeder singulator for deshingling sheets from the stack located on the feed structure;

a feed tray located remote from the feeder singulator for receiving sheets from the feeder singulator, the feed tray including a space for forming a second stack of sheets therein and the feed tray further including an opening proximate the second stack so that the sheets can be removed from the top of the second stack, the feed tray being positionable through a port in the drawer so that the second stack of sheets is positioned proximate the utlization device singulator; and wherein the feed tray extends from the feed structure at a position suspended over the floor and wherein the feed tray is constructed and arranged to engage the stack level sensor when the feed tray is positioned through the port within the drawer so that the stack level sensor indicates presence of a top sheet of the stack at a location that engages the utilization device singulator.

17. A high speed sheet feeder as set forth in claim 16 wherein the base structure includes wheels that engage the floor and that enable the base to be moved toward and away from the utilization device.

18. A high speed sheet feeder as set forth in claim 17 wherein the drawer is movable outwardly from a housing of the utlilization device to expose an interior of the drawer and wherein the interior of the drawer includes the stack feed elevator platform mounted therein.

19. A high speed sheet feeder as set forth in claim 18 wherein the feed tray is movable out of engagement with the utilization device singulator so that the feed tray can be moved outwardly from the utilization device in conjunction with the drawer, the feed tray moving outwardly in response to movement of the base on the wheels.

20. A high speed sheet feeder as set forth in claim 19 wherein a front of the drawer is mechanically interconnected with the feed structure so that each of the drawer and the feed structure move together outwardly from and inwardly toward, respectively, the utilization device.

21. A high speed sheet feeder as set forth in claim 19 wherein the feed tray is pivotally mounted on the feed structure so that it is movable toward and away from the utilization device singulator.

22. A high speed sheet feeder as set forth in claim 21 wherein the feed tray includes a supporting surface that engages at least a portion of the stack feed elevator platform so that the feed tray moves toward and away from the utilization device singulator in response to movement of the stack feed elevator platform.

23. A high speed sheet feeder as set forth in claim 22 wherein the port in the drawer includes perimeter edges that are sized to enable the feed tray to be inserted through the port in a position out of engagement with the stack feed elevator platform and out of engagement with the utilization device singulator.

* * * * *